US009359682B2

(12) United States Patent
Goto et al.

(10) Patent No.: US 9,359,682 B2
(45) Date of Patent: Jun. 7, 2016

(54) EROSION RESISTANT MACHINE COMPONENT, METHOD FOR FORMING SURFACE LAYER OF MACHINE COMPONENT, AND METHOD FOR MANUFACTURING STEAM TURBINE

(71) Applicant: MITSUBISHI ELECTRIC CORPORATION, Tokyo (JP)

(72) Inventors: Akihiro Goto, Tokyo (JP); Nobuyuki Sumi, Tokyo (JP); Yoshikazu Nakano, Tokyo (JP); Hiroyuki Teramoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/679,098

(22) Filed: Apr. 6, 2015

(65) Prior Publication Data

US 2015/0211137 A1 Jul. 30, 2015

Related U.S. Application Data

(62) Division of application No. 13/387,493, filed as application No. PCT/JP2009/003543 on Jul. 28, 2009, now abandoned.

(51) Int. Cl.
*C25D 3/56* (2006.01)
*C25D 5/18* (2006.01)
(Continued)

(52) U.S. Cl.
CPC . *C25D 3/56* (2013.01); *C23C 26/00* (2013.01); *C25D 5/18* (2013.01); *F01D 5/286* (2013.01);
(Continued)

(58) Field of Classification Search
CPC ..... C25D 3/56; C25D 5/18; Y10T 29/49321; C23C 26/00; F01D 5/286; F01D 5/288; F01D 25/285; F01D 2220/31; F01D 2230/00
See application file for complete search history.

(56) References Cited

U.S. PATENT DOCUMENTS 4,948,625 A 8/1990 Suzuki et al.
4,965,139 A 10/1990 Kabacoff et al.
(Continued)

FOREIGN PATENT DOCUMENTS

CN 1826456 A 8/2006
EP 0211310 B1 12/1991
(Continued)

OTHER PUBLICATIONS

International Search Report [PCT/ISA/210], issued by the International Searching Authority in corresponding International Application No. PCT/JP2009/003543 on Oct. 20, 2009.
(Continued)

*Primary Examiner* — Kishor Mayekar
(74) *Attorney, Agent, or Firm* — Sughrue Mion, PLLC; Richard C. Turner

(57) ABSTRACT

A method for forming a surface layer, the purpose thereof is to form a high erosion resistant film. The method for forming a surface layer includes: arranging a member (2) in a machining fluid (3); and forming the surface layer including silicon by spacing a silicon electrode (1) from the member (2) at a predetermined distance, and by supplying silicon component from the silicon electrode (1) to the member side by applying a predetermined voltage and generating electric discharge, and an iron-based metal texture including silicon of 3 to 11 wt % is formed at a thickness of 5 to 10 μm at a portion to be treated by repetitively generating a electric discharge pulse in which a time integration value of a current value of the electric discharge pulse is in a range of 30 A·μs to 80 A·μs.

2 Claims, 24 Drawing Sheets

(51) Int. Cl.

| | |
|---|---|
| ***C23C 26/00*** | (2006.01) |
| ***F01D 5/28*** | (2006.01) |
| ***F01D 25/28*** | (2006.01) |

(52) U.S. Cl.

CPC ..... *F01D 5/288* (2013.01); *F01D 25/285* (2013.01); *F05D 2220/31* (2013.01); *F05D 2230/00* (2013.01); *Y10T 29/49321* (2015.01)

(56) References Cited

U.S. PATENT DOCUMENTS

| | | | |
|---|---|---|---|
| 6,602,561 | B1 | 8/2003 | Moro et al. |
| 6,808,604 | B1 | 10/2004 | Goto et al. |
| 7,537,809 | B2 | 5/2009 | Ochiai et al. |
| 7,575,418 | B2 | 8/2009 | Gigliotti et al. |
| 7,918,460 | B2 | 4/2011 | Ochiai et al. |
| 2002/0132131 | A1 | 9/2002 | Bossmann et al. |
| 2007/0104585 | A1 | 5/2007 | Ochiai et al. |
| 2007/0184298 | A1 | 8/2007 | Ochiai et al. |
| 2010/0124490 | A1 | 5/2010 | Ochiai et al. |
| 2011/0027099 | A1 | 2/2011 | Ochiai et al. |
| 2012/0114956 | A1 | 5/2012 | Ochiai et al. |

FOREIGN PATENT DOCUMENTS

| | | | |
|---|---|---|---|
| JP | 5-13765 | B2 | 2/1993 |
| JP | 3001592 | B2 | 1/2000 |
| JP | 2005-214147 | A | 8/2005 |
| JP | 2006-70297 | A | 3/2006 |
| JP | 2006-124830 | A | 5/2006 |
| JP | 2008-218037 | A | 9/2008 |
| WO | 01/55481 | A1 | 8/2001 |
| WO | 2004/033755 | A1 | 4/2004 |

OTHER PUBLICATIONS

Written Opinion [PCT/ISA/237] of the International Searching Authority, issued in corresponding International Application No. PCT/JP2009/003543 on Oct. 20, 2009.

Communication, dated Jul. 30, 2013, issued by the Japanese Patent Office in counterpart Japanese Application No. 2011-524539.

Office Action issued Sep. 3, 2013, by the German Patent and Trademark Office in corresponding application No. 11 2009 005 100.6.

Communication dated Apr. 19, 2013 from the State Intellectual Property Office of P.R. China in a counterpart application No. 200980160703.8.

Si FILM
(TREATING CONDITION B, FILM THICKNESS: AVERAGE 11μm)

EROSION RESISTANT MACHINE COMPONENT, METHOD FOR FORMING SURFACE LAYER OF MACHINE COMPONENT, AND METHOD FOR MANUFACTURING STEAM TURBINE

This application is a Divisional of U.S. application Ser. No. 13/387,493 filed Jan. 27, 2012, which is a National Stage application under 35 U.S.C. §371 of International Application No. PCT/JP2009/003543, filed on Jul. 28, 2009 in the United States Patent and Trademark Office, the disclosures of which are incorporated herein by reference in their entireties.

TECHNICAL FIELD

The present invention relates to, for example, a steam turbine part which is a machine component that requires an erosion resistance, and a forming method thereto.

BACKGROUND ART

Erosion, such as a member being eroded by collision with wet steam including water droplet at a high speed, is a critical issue in a steam turbine blade, piping of a pump and fluid injection components, and various efforts against the erosion have been made.

JP-A-2006-124830 discloses that an erosion resistance performance is obtained by forming a protective structure made of a material such as α-β titanium alloy, near β titanium alloy or β titanium alloy on turbine components, with respect to an erosion resistant structure using a film or clad made of a conventional cobalt base alloy such as Stellite® and Haynes 25.® (Patent Document 1)

Japanese Patent No. 3001592 discloses that, as a measure for erosion resistant to a steam turbine, $Cr_3C_2$ with stainless powder as binder is thermally sprayed into the turbine components (Patent Document 2).

JP-A-2006-70297 discloses a method for improving erosion resistance, in which a surface of a carbide film is melted by a heat source having a high energy density such as laser or EBW to perform a sealing process after the carbide film is formed on a steam turbine member by high-pressure high-velocity flame spraying (Patent Document 3).

PRIOR ART DOCUMENT

Patent Document

Patent Document 1: JP-A-2006-124830
Patent Document 2: Japanese Patent No. 3001592
Patent Document 3: JP-A-2006-70297

SUMMARY OF INVENTION

Problem to be Solved by the Invention

As described above, various methods have been attempted as the measure for erosion resistant. However, in Patent Document 1, in formation of the structure, there is required a difficult method in which the structure is pushed toward a member with high temperature and high pressure to perform diffusion bonding. In Patent Document 2, because a large number of voids exist in the formed film, the erosion resistance is insufficient. Further, the performance deterioration as the steam turbine, which is attributable to existence of the voids, is not taken into consideration. In Patent Document 3, there arises a problem that the surface is melted by a method using high energy density such as laser whereby heat influence remains, and strain remains in the member.

That is, in the method of attaching another material to the member such as welding or brazing, an excessive heat is input to the member. Therefore, deformation of the member and deterioration of strength cannot be avoided. Those methods are manually performed, and require skill. The erosion resistant performance cannot be obtained sufficiently. There arise these problems.

Also, as the materials suitable for the erosion resistance, various materials have been tried as disclosed in the above-mentioned patent documents. However, under the existing circumstance, a material that is sufficiently satisfactory has not been found. Two reasons are roughly conceivable for this.

A first reason is that the material suitable for the erosion resistance has not yet been clarified in theory. Erosion is generated by collision with water droplet or material as the primary cause. However, harder material is not always excellent in the erosion resistance. Various materials are subjected to a process of trial and error, and under the existing circumstances, a material such as Stellite (registered trademark) has been widely used.

A second reason is that even when there is a material excellent in the erosion resistance, at many times, it is difficult to attach the material onto a member to be treated.

At present, various coating technologies have been developed so that even a hard material can be attached onto the surface of the member to be treated. However, treatment itself is frequently limited. For example, in the case of a large member such as the steam turbine blade, it is extremely industrially difficult to insert the member itself into a vacuum device, and treat the member one by one.

An object of the present invention is to form an excellent erosion resistant film which solves the above problems. In particular, for the purpose of avoiding excessive heat input and reducing a unit of energy to be used when attaching a material to a member, a heat effect on the member is reduced with the use of a fine pulse discharge, resulting in that deformation and deterioration in strength can be reduced as much as possible.

Also, there is provided a method that can implement treatment of the member mechanically and automatically without depending on skill

Means to Solve the Problem

An erosion resistant machine component according to the present invention is characterized in that a surface layer that is formed by arranging the erosion resistant machine component in a machining fluid and by generating electric discharge between silicon electrode spaced by a predetermined distance to supply silicon component from the silicon electrode to a member side is formed of an iron-based metal texture silicon of 3 to 11 wt % at a thickness of 5 to 10 μm.

Effects of the Invention

According to the present invention, by an electric discharge using a Si electrode, a high-quality film can be stably formed on the member, and a surface layer can be formed which exerts a high erosion resistance.

Also, an improvement in the erosion resistance of the steam turbine blade, piping components, or the fluid injection components can be performed without relying on manpower and without dispersion.

EMBODIMENTS OF INVENTION

Hereinafter, embodiments of the present invention will be described with reference to the drawings.

First Embodiment

Figure 1:
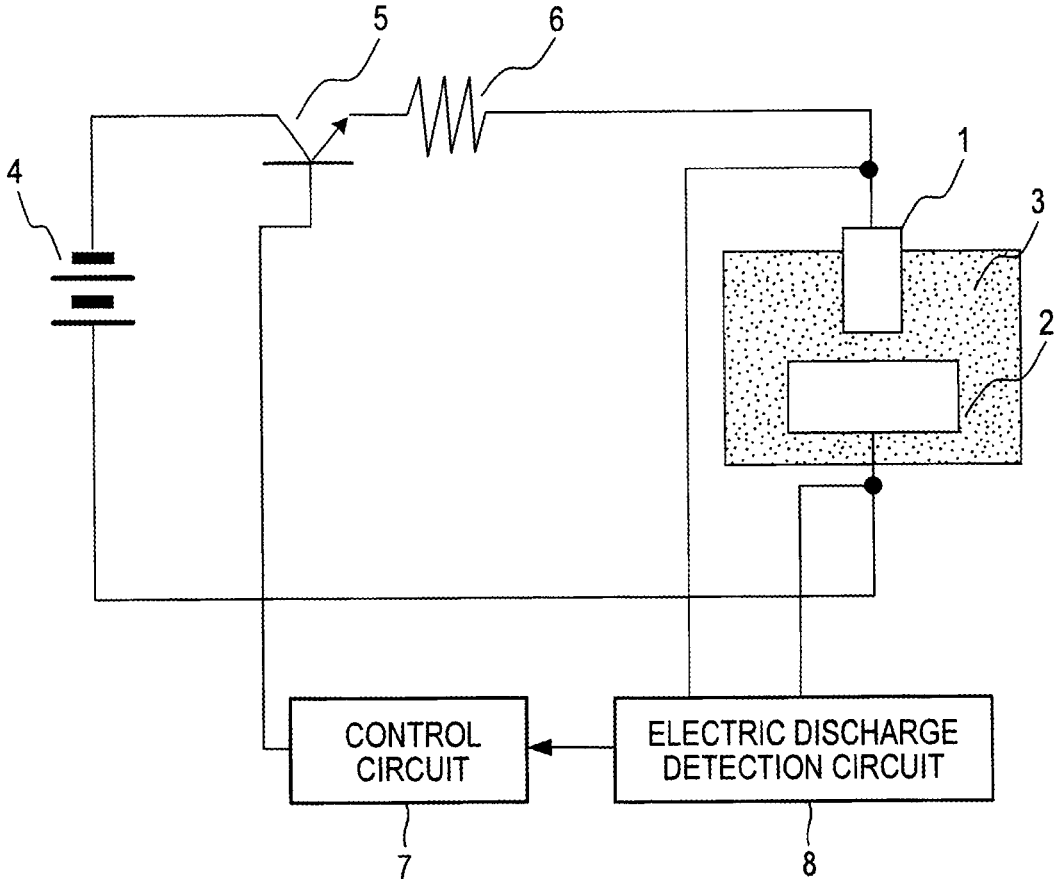
FIG. 1 is an illustrative diagram of an electric discharge surface treatment system.

FIG. 1 illustrates an outline of an electric discharge surface treatment method in which pulsed electric discharge is generated between a Si electrode and a member, and a texture having an erosion resistant function is formed on a surface of the member. In the figure, reference numeral 1 is a solid metal silicon (Si) electrode, 2 is a member to be treated such as a steam turbine blade, 3 is an oil that is a machining fluid, 4 is a DC power supply, 5 is a switching element for applying (or stopping) a voltage of the DC power supply 4 between the Si electrode 1 and the member 2, 6 is a current-limiting resistor for controlling a current value, 7 is a control circuit for controlling on/off operation of the switching element 5, and 8 is an electric discharge detector circuit for detecting the voltage between the Si electrode 1 and the member 2 to detect the generation of electric discharge.

Figure 2:
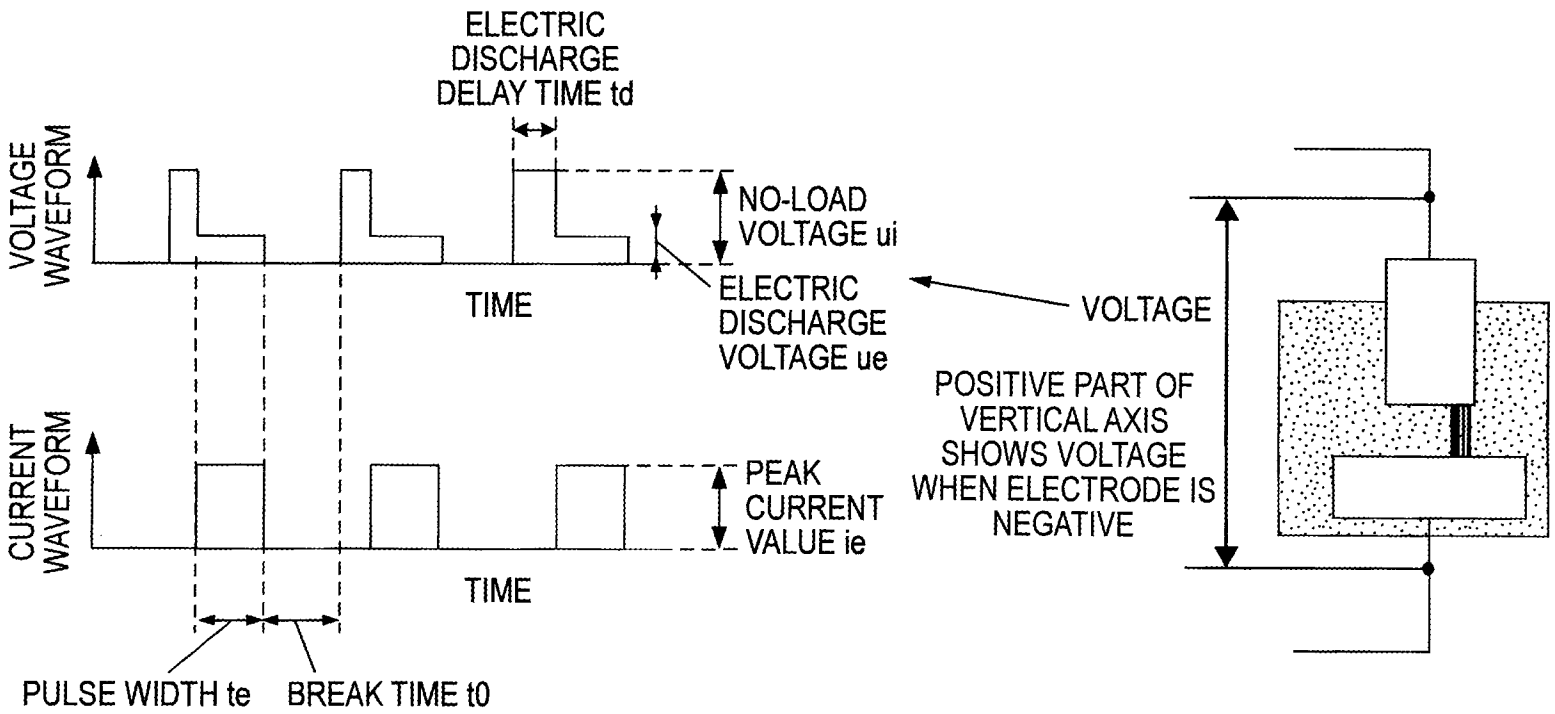
FIG. 2 is a diagram illustrating voltage and current waveforms in the electric discharge surface treatment.

Subsequently, the operation will be described with reference to FIG. 2 illustrating voltage and current waveforms.

When the switching element 5 is turned on by the control circuit 7, a voltage applied between the Si electrode 1 and the member 2. With an electrode feed mechanism which is not shown, an interpolar distance between the Si electrode 1 and member 2 is controlled to an appropriate distance (a distance allowing electric to be generated), and after a short time, electric discharge is generated between the Si electrode 1 and the member 2. A current value ie of a current pulse, a pulse width te (electric discharge duration), and an electric discharge break time t0 (a time during which no voltage is applied) are set in advance, and determined according to the circuit 7 and the current-limiting resistor 6.

When the electric discharge is generated, the electric discharge detector circuit 8 detects the generation of electric discharge according to a decrease in the voltage between the Si electrode 1 and the member 2, and timing, and the control circuit 7 turns off the switching element 5 a predetermined time (pulse width te) after the electric discharge is detected.

The control circuit 7 again turns on the switching element 5 a predetermined time (break time t0) after the switching element 5 turns off.

The above operation is repetitively performed so that the electric discharge of a continuously set current wave can be generated.

In FIG. 1, the switching element is illustrated as a transistor. However, another element may be used if the element can control the application of a voltage. Also, the current value is controlled by the resistor. However, it is needless to say another element may be used if the element can control the current value.

Also, in the illustration of FIG. 1, the waveform of the current pulse is a rectangular wave. However, another waveform may be used. A large amount of Si material can be supplied by increasing the consumption of the electrode, or the material can be effectively used by reducing the consumption of the electrode, depending on the shape of the current pulse. However, this will not be discussed in detail in the present specification.

As described above, a layer including a large amount of Si therein can be formed on a surface of the member 2 by continuously generating electric discharge between the Si electrode 1 and the member 2.

However, in order to stably form the high-quality Si contained layer, not all kinds of Si can be used. Also, there is a necessary condition in the circuit of FIG. 1. The condition will be described in detail later.

First, prior to the description of conditions of the Si electrode and the circuit, in order to clarify differences of the electric discharge surface treatment between the conventional art and this embodiment, a film formation technology using the electric discharge machining will be described.

JP-B-5-13765 discloses a technique in which, with the use of silicon as an electrode of the electric discharge machining, an amorphous alloy layer or a surface layer of high corrosion resistant and high heat resistant characteristics with a fine crystal structure is formed on a surface of a workpiece.

The electric discharge machining by the Si electrode disclosed in that publication is performed by a technique in which an energy having a peak value Ip of 1 A is supplied through a circuit system that turns on/off a voltage periodically with a voltage application time fixed to 3 μs and a break time fixed to 2 μs.

For that reason, in a period of 3 μs during which the voltage is applied, where of the voltage pulse to generate each electric discharge is different from each other, and the current pulse width which is a real electric discharge duration where a current flows is successively changed, and the stable film formation is difficult.

Figure 3:
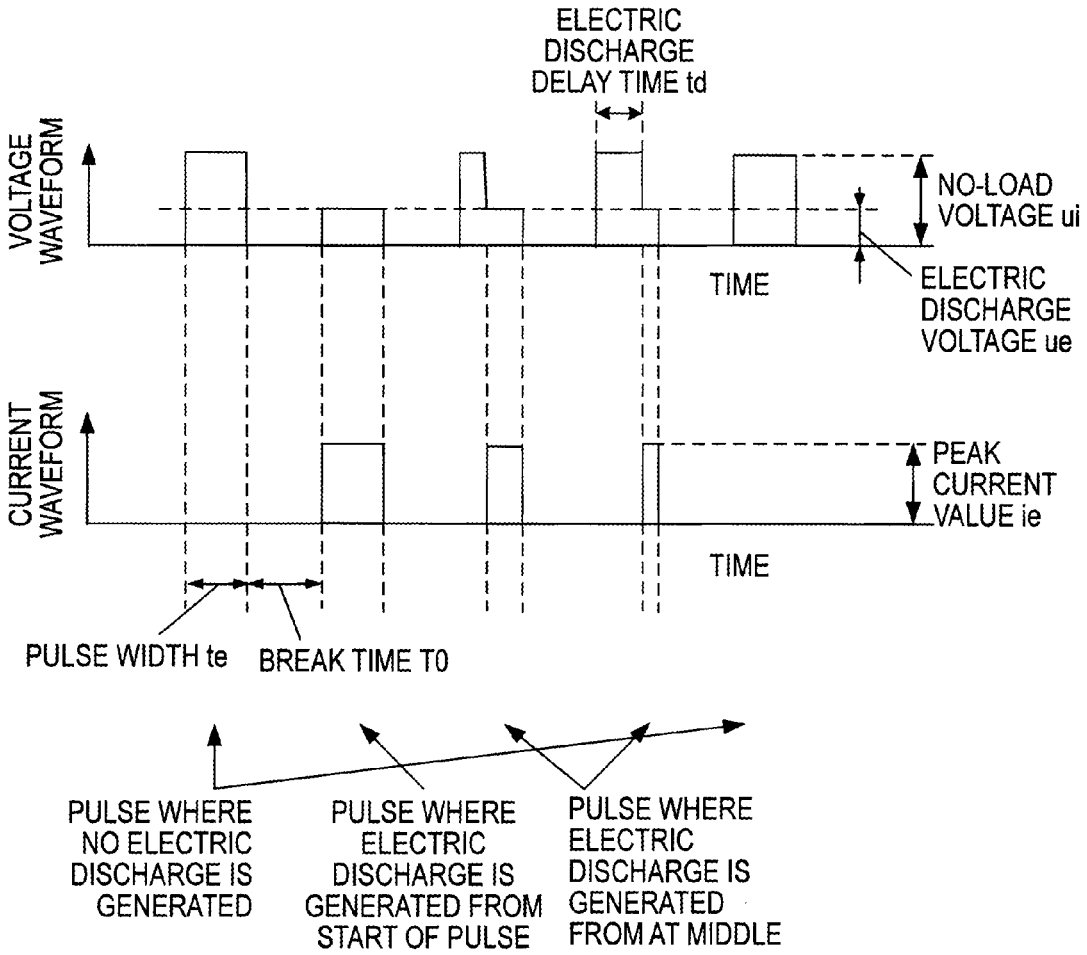
FIG. 3 is a diagram illustrating an electric discharge phenomenon.

For example, as exemplified in FIG. 3, in a power supply of a circuit system in which the voltage periodically turns on and off, a voltage waveform and a current waveform are changed, and a phenomenon that energy for each pulse is different occurs. Also, the amount of Si, which is an electrode material, to be supplied to the member and energy for melting the surface of the member to form the surface layer are varied. Therefore, stable treatment is difficult.

In the drawing, a voltage of the electric discharge is constant, and a current thereof is also constant. However, actually, the voltage fluctuates, and also the current fluctuates. Also, when the electrode is made of a high resistant material such as Si, because a voltage depression attributable to Si is also included in the voltage, the voltage is high, and the fluctuation also becomes large.

Subsequently, a reason that the voltage must be periodically turned on and off in the publication as described above will be described.

In the publication, a condition of a very small current pulse is made with the use of silicon which is a high resistant material about 0.01 Ωcm in specific resistivity.

For that reason, in the conventional control system that detects an arc potential of electric discharge to detect the generation of electric discharge, in the case where electric discharge is generated when the electrode is made of the high resistant material, a value, in which a voltage of the voltage depression when a current flows in the Si electrode is added to the arc potential, is detected. When the voltage of the voltage depression is high, the circuit cannot recognize that electric discharge is generated despite the generation of electric discharge.

Also, the silicon film produced by the conventional electric discharge machining suffers from a problem that the treatment is largely varied, and cannot be stably performed.

This problem is also attributable to a fact that Si is high in resistance.

Figure 4:
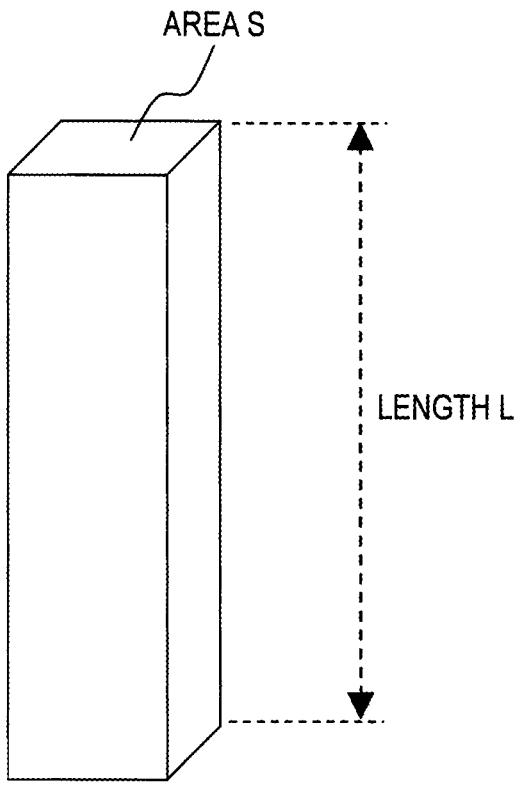
FIG. 4 is a diagram illustrating a relationship of a resistance value R, a resistivity ρ, an area S, and a length L.

For example, when it is assumed that a resistance value is R, a resistivity is ρ, an area is S, and a length is L as illustrated in FIG. 4, a resistance value R of the electrode is represented by $R=\rho \cdot L/S$.

However, if ρ is large, a value of R is largely varied according to a method for supplying electricity to the electrode, that is, an electrode holding method.

In the conventional art, silicon of ρ=0.01 Ωcm is used as the electrode. However, in the case of the material having such a high resistance, the treatment cannot be performed without any condition. For example, when the Si electrode is long, electricity is fed to the electrode while holding one end of the electrode, the resistance of the electrode is higher if the electrode is longer, and the resistance becomes lower as the length is shorter. When the electrode is long and the resistance is high, electric discharge cannot be detected as described above, and a probability that an abnormal pulse is generated is also high. Even if no abnormality occurs, because the resistance is high, a current value of electric discharge becomes low.

Through the research of the present inventors, when silicon having a resistance value of about ρ=0.01 Ωcm is used as the electrode, if the electric discharge is generated when an electrode length becomes about several tens mm or higher, the voltage depression at the electrode, which is attributable to a current, becomes large, abnormal electric discharge is generated, and the formation of the surface layer may become difficult.

Also, it has been found that a condition under which such abnormal electric discharge is generated is determined according to an electricity feed position and an electric discharge position, that is, a length of the electrode, and is irrelevant to an area (thickness) of the electrode.

It can be assumed that this is because when a current flows in the electrode, the current does not uniformly flow over the entire cross section of the electrode, but flows in a certain thin channel. Accordingly, even when silicon having a resistivity of 0.01 Ωcm or more is used as the electrode, if a position where the electric discharge is generated and an electricity feed point are brought closer to each other, suitable electric discharge can be generated. If plate-like silicon of, for example, about 1 mm is joined to a metal for feeding electricity, even if the resistance value is about 0.05 Ωm, stable electric discharge is enabled. However, when even the electrode of 0.01 Ωcm has a length of about several tens mm or more, for example, about 100 mm, abnormal electric discharge may be generated, and stable treatment is difficult.

The following facts have been proved from the experiments of the present inventors as discussed above.

- In order to form the surface layer including Si on the surface of the member through the use of pulse discharge in oil with silicon as the electrode, with a thickness of about 10 μm so as to withstand industrial use, at a high speed, Si low in resistance is used, and a circuit of a system that controls (substantially uniforms the pulse widths) pulse widths (electric discharge current pulses) of electric discharge as illustrated in FIGS. 1 and 2 must be used.
- In order to form the surface layer of about 10 μm or more on the member surface with silicon as the electrode, a lower resistance value (specific resistance) is preferable. When it is assumed that the electrode having a length of about 100 mm or higher is used from the viewpoint of actual industrial use, it is desirable that ρ is 0.005 Ωcm or lower. In order to decrease the resistance value of Si, the concentration of so-called impurity can be increased such that Si is doped with other elements.
- When the electricity feed point and the electric discharge position are brought closer to each other, even if ρ is 0.005 Ωcm or more, stable treatment can be performed. An index in this situation may be provided as follows, including a case in which ρ is 0.005 Ωcm or lower.

That is, it is recognized that electric discharge is generated by a decrease in a voltage applied between poles. A power supply allows the application of the voltage to be stopped (that is, electric discharge is stopped) a predetermined time (pulse width te) after it is recognized that the electric discharge is generated. With this power supply, in forming the surface layer including Si on the surface of the member with Si as the electrode, the treatment can be performed in a state where an interpole voltage including voltage depression at the Si electrode, which is a resistor when electric discharge is generated, becomes lower than an electric discharge detection level.

Figure 5:
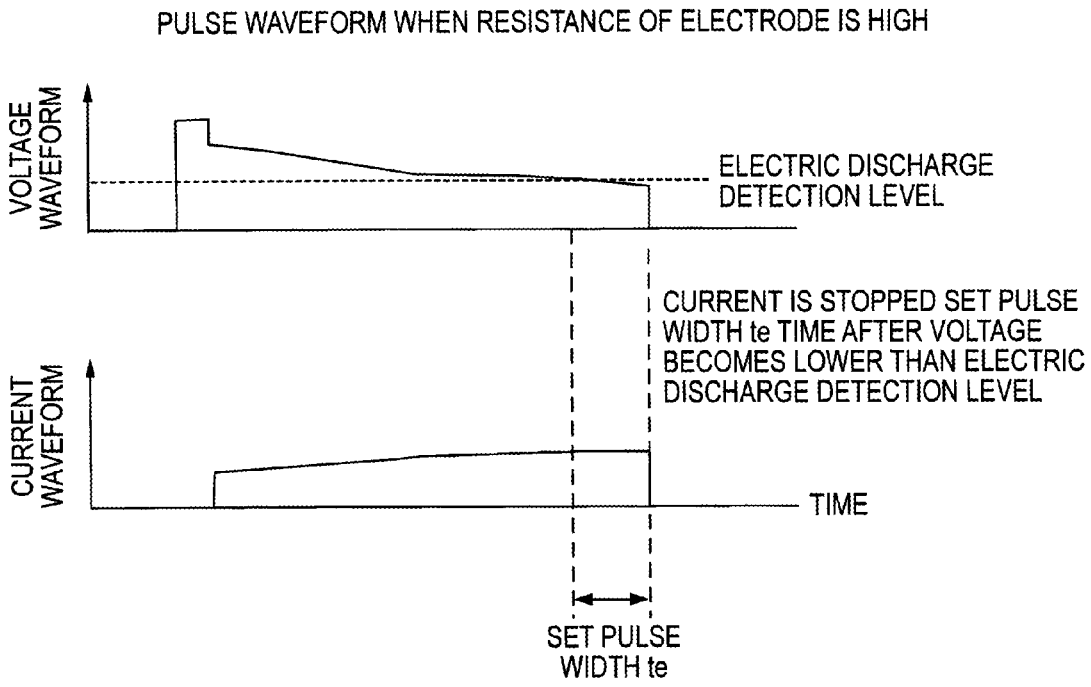
FIG. 5 is a diagram illustrating a current waveform when electric discharge cannot be detected.

In general, a potential of the arc is about 25V to 30V. A voltage of the discharge detection level may be set to be lower than the supply voltage, and higher the potential of the arc. However, if the electric discharge detection level is set to be low, unless the resistance value of Si is decreased, the generation of electric discharge cannot be recognized even if the electric discharge is generated. As a result, a risk, in which an abnormally long pulse is generated as illustrated in FIG. 5, increases.

If the electric discharge detection level is set to be high, even if the resistance of Si is slightly high, the interpole voltage is liable to fall below the electric discharge detection level when the electric discharge is generated. That is, when the resistance value of Si is low, the electrode may be long. When the resistance value of Si is high, the length of Si is shortened so that the interpole voltage when electric discharge is generated becomes lower than the electric discharge detection level. Although the electric discharge detection level may be set to be lower than the supply voltage and higher than the potential of the arc, according to the above description, it is preferable that the electric discharge detection level is set to a level slightly lower than the supply voltage.

Through the experiment of the present inventors, there has been found that to set the electric discharge detection level to a value lower than the supply voltage by about 10 to 30 V has the highest versatility in the practical use. More strictly, by setting the electric discharge detection level to a value lower than the supply voltage by about 10 to 20 V, there is a wide range in the kinds of Si that can be used.

By satisfying the conditions described above, it is possible to stably and freely generate an electric discharge pulse while using Si, which is a high-resistance material, as an electrode. Accordingly, it is possible to form a surface layer including Si on the member.

As it is possible to form the surface layer including Si as described above, by examining the properties of the surface layer including Si, the following things have been found out.

Figure 6:
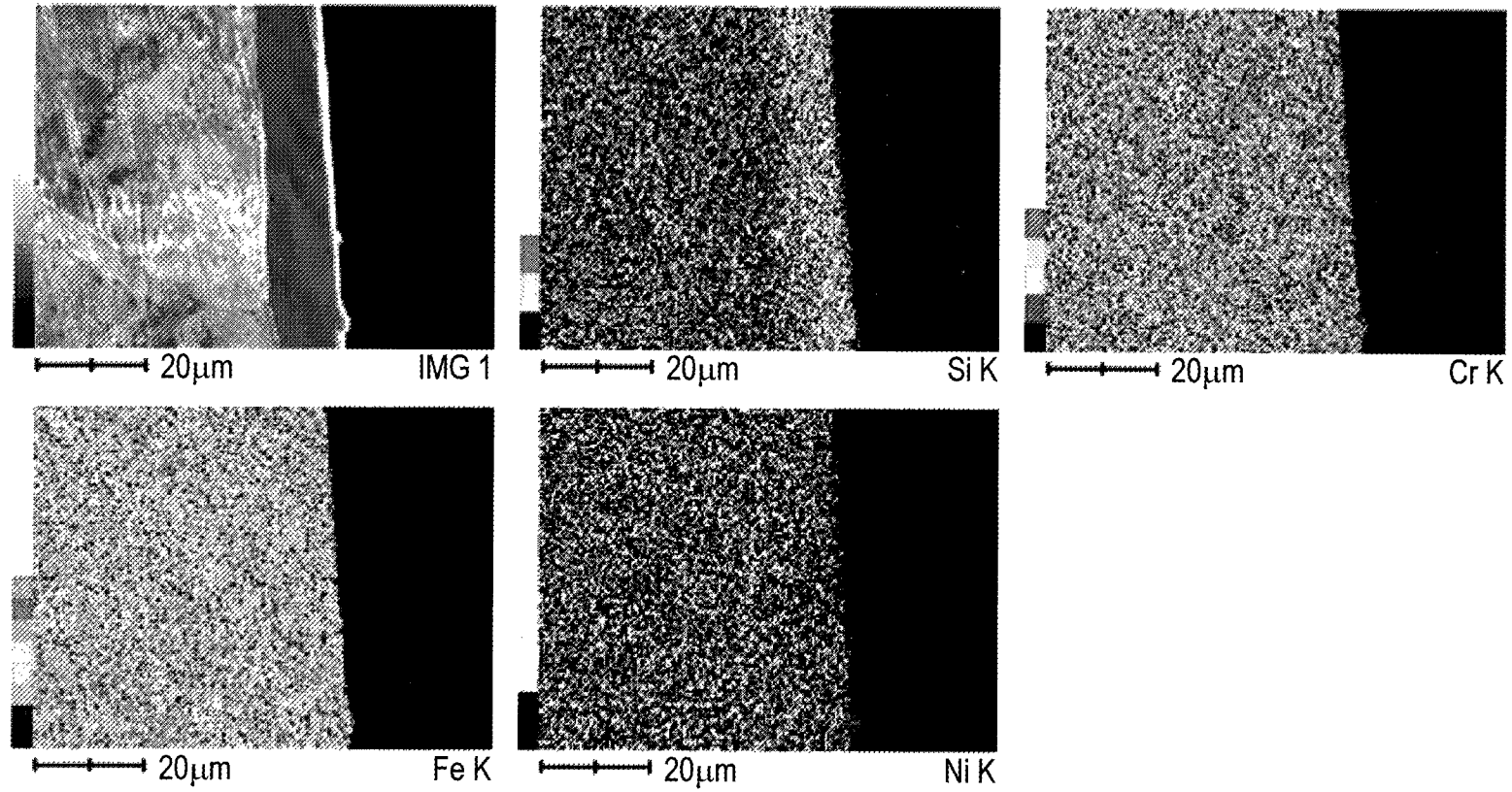
FIG. 6 is a diagram illustrating an analysis result of a surface layer including Si.

FIG. 6 is an analysis result of a surface layer including Si. The upper left photograph is an SEM photograph of a cross-section of the Si surface layer, the upper middle one is a surface analysis result of Si, the upper right one is a surface analysis result of Cr, the lower left one is a surface analysis result of Fe, and the lower right (middle) one is a surface analysis result of Ni.

It was found out from the result that the surface layer has a thickness of a certain extent. However, in the Si surface layer, Si is not stacked on the parent material, and rather, Si is integrated with the parent material, such that the surface layer is achieved in a state as if Si permeates in the parent material in a high concentration. The surface layer is an iron-based metal texture of which the content of Si is increased, and since the expression, film, is not appropriate, it is simply referred to as a Si surface layer hereainfter. In the surface layer, a part in which the amount of Si increases even slightly as compared to the parent material according to a componential analysis is defined as the surface layer.

As a result, unlike other surface treatment methods, a film is not separated from the parent material in the surface layer. As a result of investigating the surface layer, it has been found that the surface layer has an extremely high erosion resistance when a predetermined condition is satisfied. The erosion is a phenomenon that a member is eroded by water colliding with the member, which causes a failure in piping components through which water or steam passes or the rotor blade of the steam turbine. As technologies for erosion resistance, there are various prior art as described above. However, the respective prior art has problems.

First, a test result showing a high erosion resistance of a Si surface layer satisfying predetermined conditions is described. The predetermined conditions will be described later.

In the erosion resistance performance according to this embodiment, the test results will be described below.

Figure 7:
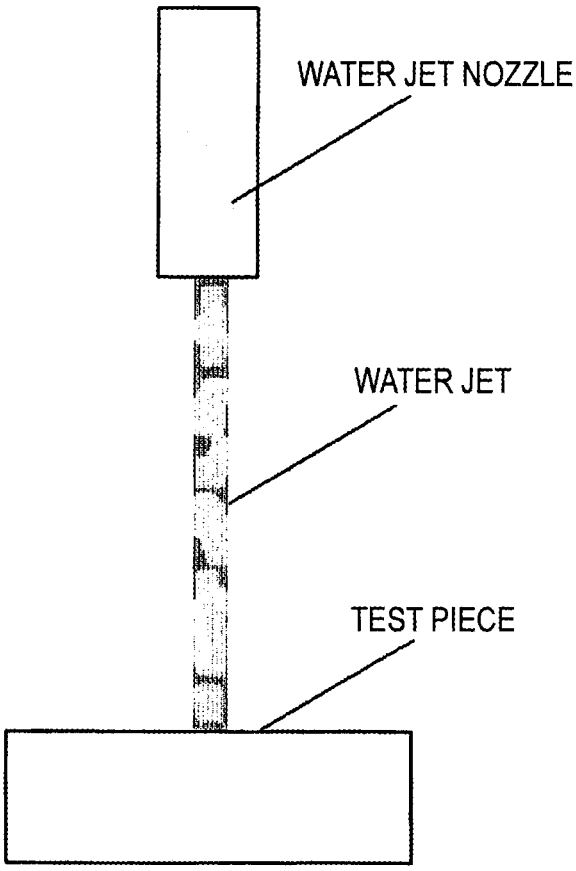
FIG. 7 is a schematic diagram of an evaluation test of erosion resistance.

FIG. 7 illustrates an outline of tests in which a water jet is applied to test pieces to compare appearances of erosion with each other as the evaluation of the erosion resistance.

The water jet is applied under a pressure of 200 MPa. The test pieces as used include four kinds of 1) stainless base material, 2) Stellite (material intended for erosion resistance, 3) a TiC film by electric discharge, and 4) a surface layer including a large amount of Si according to the present invention, which is formed on stainless steel. The film of 3) is a TiC film formed through a method disclosed in WO 01/005545, which has a high hardness.

The water jet is applied to the respective test pieces for 10 seconds, and the erosion of the test pieces is measured by a laser microscope.

Figure 8:
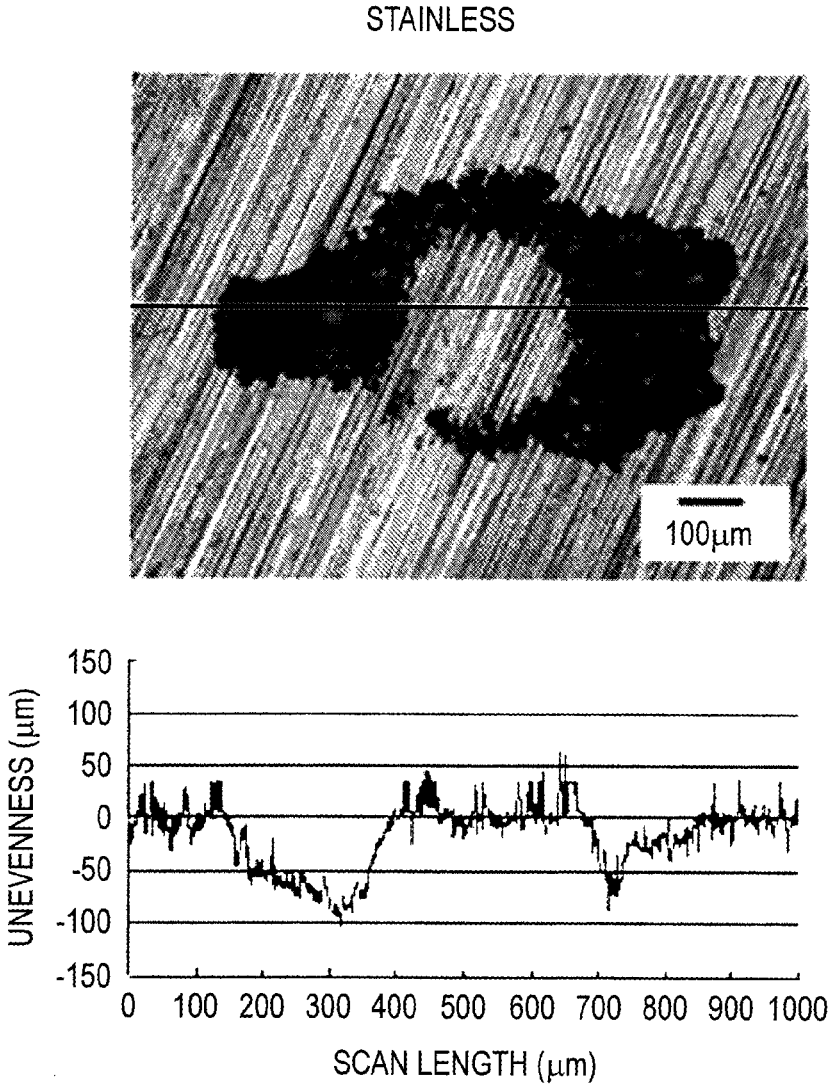
FIG. 8 is a diagram illustrating an evaluation test result of a stainless base material.
Figure 9:
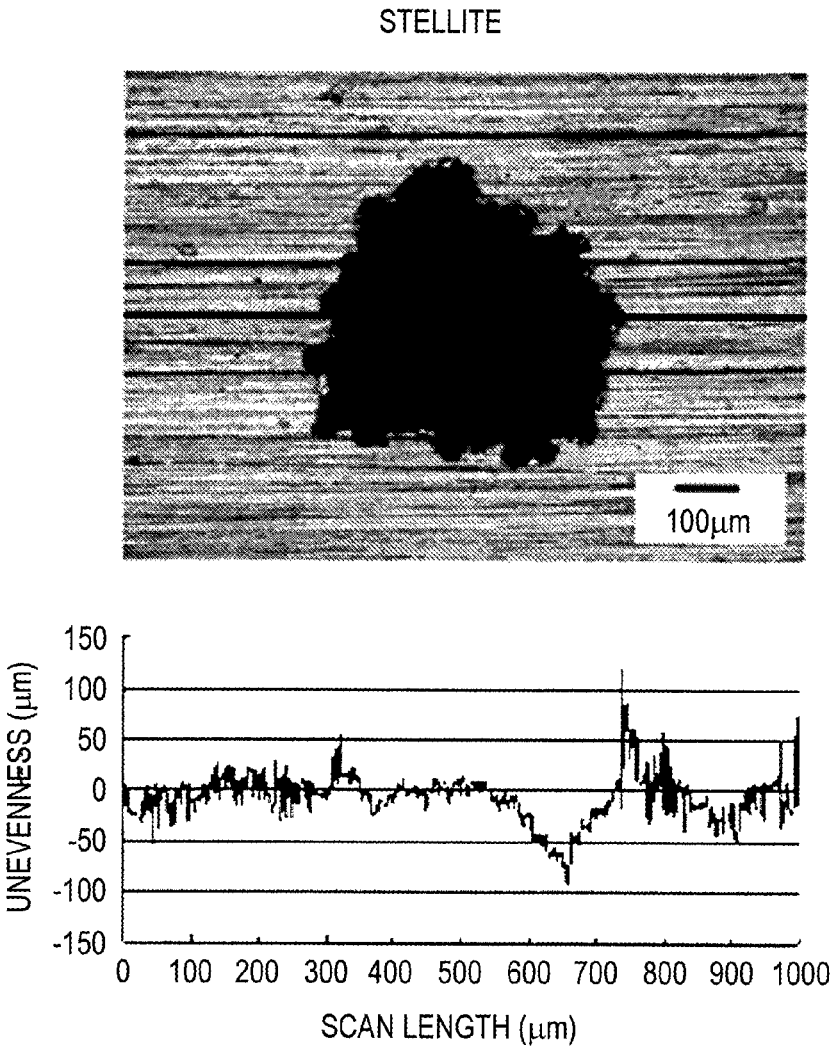
FIG. 9 is a diagram illustrating an evaluation test result of Stellite.
Figure 10:
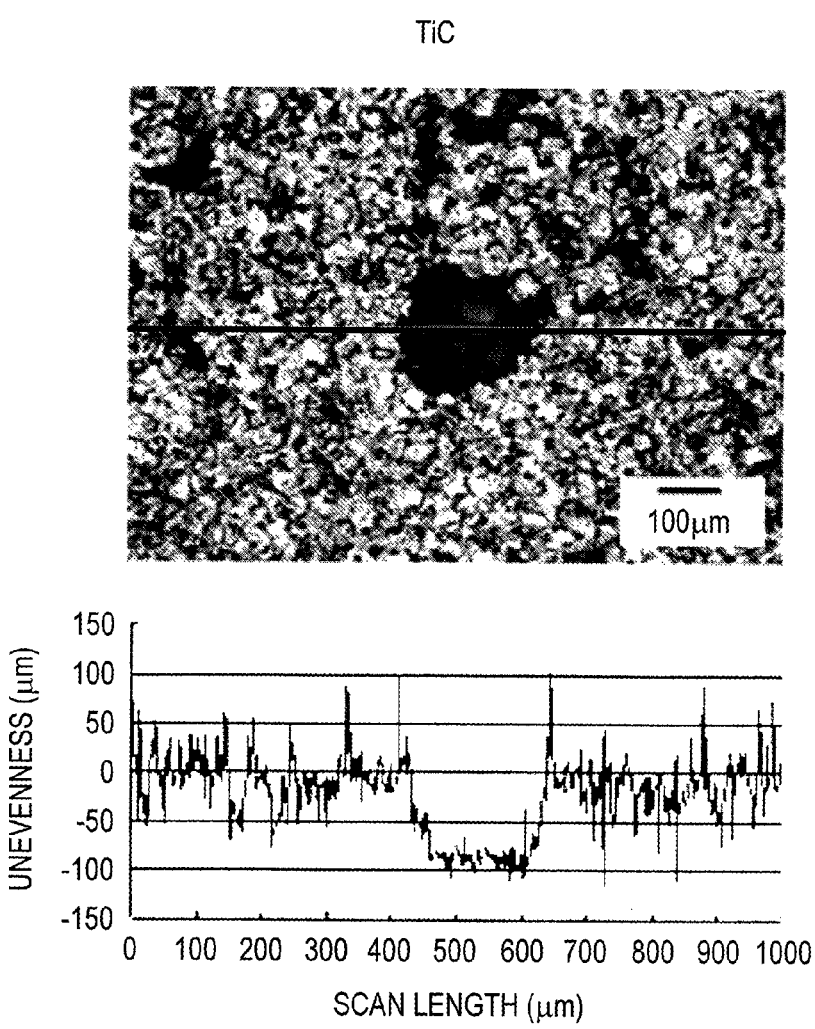
FIG. 10 is a diagram illustrating an evaluation test result of a TiC film.
Figure 11:
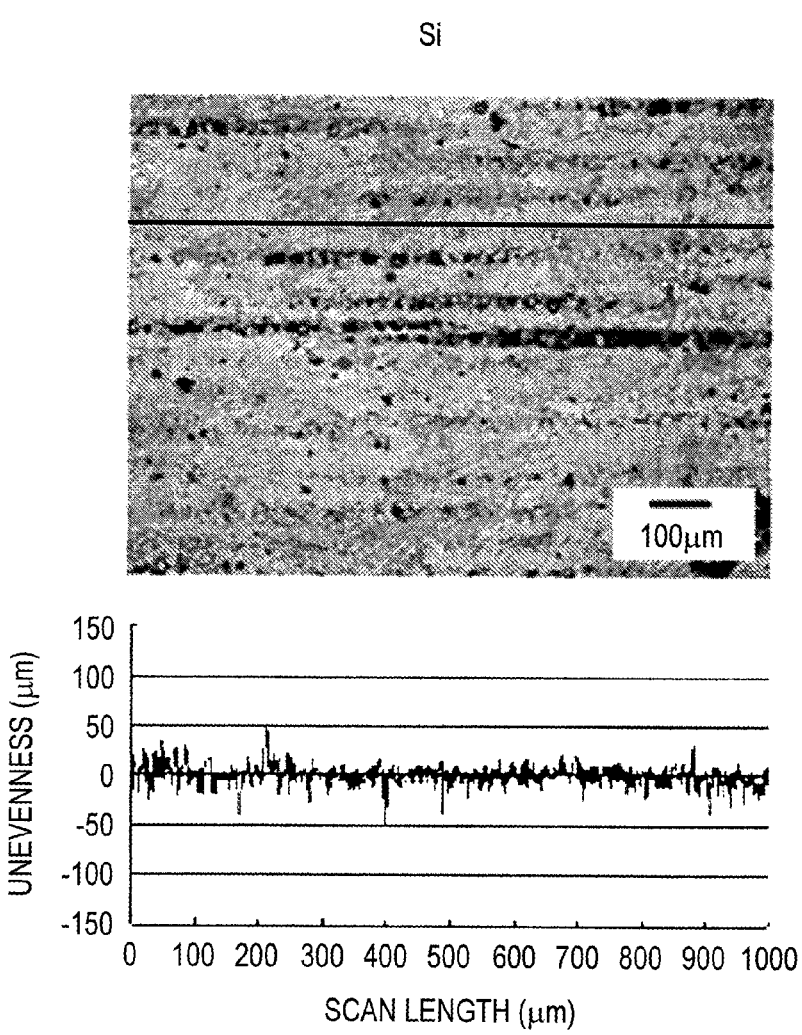
FIG. 11 is a diagram illustrating an evaluation test result of a Si surface layer.

FIG. 8 illustrates a result of 1), FIG. 9 illustrates a result of 2, FIG. 10 illustrates a result of 3), and FIG. 11 illustrates a result of 4), that is, in the case of the surface layer according to this embodiment.

As illustrated in FIG. 8, the stainless base material is eroded to a depth of about 100 μm when the water jet is applied to the stainless base material for 10 seconds.

On the contrary, as illustrated in FIG. 9, in the Stellite material, although the appearance of erosion is different, the depth is about 60 to 70 μm, and the erosion resistance of the Stellite material is confirmed to some extent.

FIG. 10 illustrates the result of the TiC film that is very high in hardness. The TiC film is eroded to the depth of about 100 μm, and from this result, it is found that the erosion is caused by not only the hardness of the surface.

On the other hand, FIG. 11 illustrates the result in the case of the surface layer of Si according to this embodiment. It is found that the surface layer is hardly eroded.

The hardness of the surface layer is about 800 HV (because the thickness of the surface layer is thin, the hardness is measured by a micro Vickers hardness meter with a load of 10 g. A range of the hardness is about from 600 to 900 HV.). This hardness is higher than that of the stainless base material (about 350 HV) illustrated in 1), or the Stellite material (about 420 HV) illustrated in 2), but lower than that of the TiC film (about 1500 HV) illustrated in 3).

That is, it is found that the erosion resistance is a multiple effect related to not only the hardness but also other properties.

In FIG. 10, it appears that the film is hollowed regardless of the hard film. Therefore, it is guessed that even if only the surface is hard, when the surface is not tough and the film is thin, the film is broken by impact of the water jet.

On the contrary, according to another test, the film of 4) according to this embodiment is tough and has a surface that withstands deformation. It is guessed that this causes a high erosion resistance. Experimentally, the TiC film and the Si surface layer are formed on a thin plate surface. When a bending test is performed, the TiC film is immediately cracked, but the Si surface layer is hardly cracked.

The surface layer of 4) is tested with a thickness of about 5 μm. However, if the film is thin, it is confirmed that the strength is not sufficient, and the film is liable to be eroded.

In JP-B-5-13765 that is prior art, the Si film is researched, and although a high corrosion resistance is shown, the erosion resistance cannot be found. It can be guessed that one of the major reasons the erosion cannot be found is because the surface layer cannot be thickened.

In the case of the erosion resistance, although depending on a collision speed of a material such as water which causes erosion, it is desirable that the surface layer is 5 μm or more. When the speed of the colliding material is low, the effect may be sufficiently exerted if the surface layer is 2 to 3 μm or more.

Figure 12:
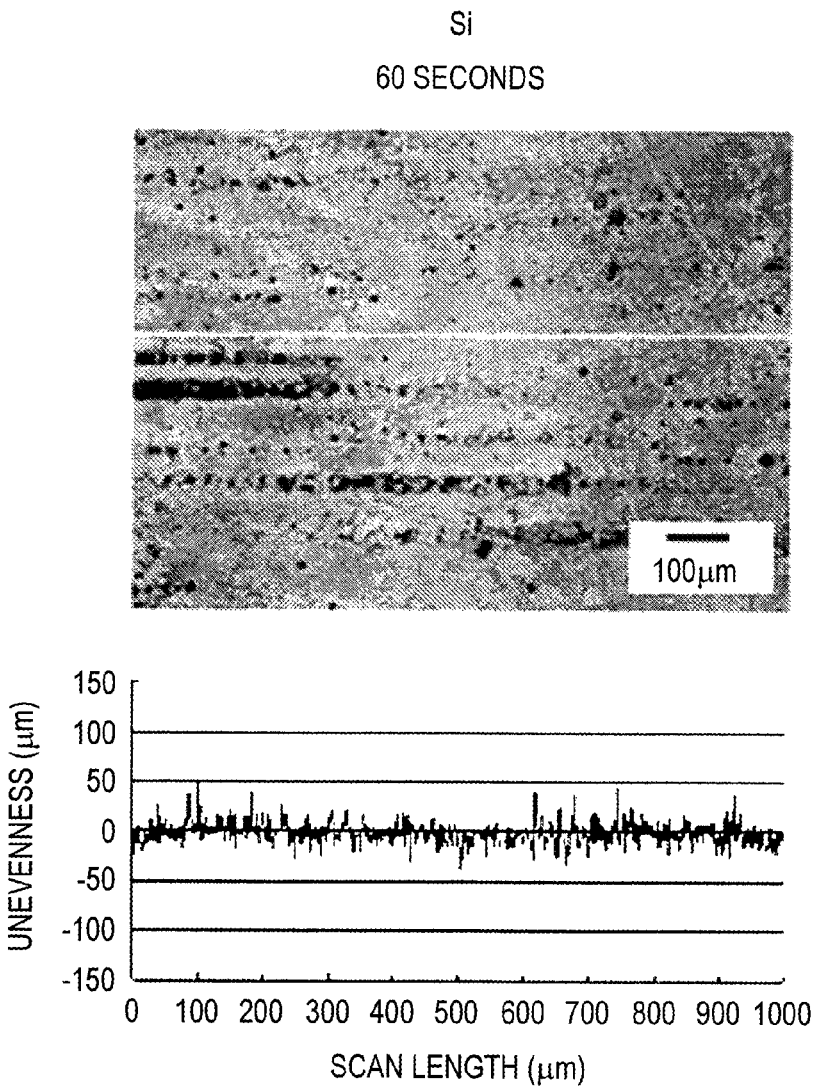
FIG. 12 is a diagram illustrating an evaluation test result of a Si surface layer.

In the test on the surface layer of Si illustrated in 4), erosion can be hardly recognized. Therefore, the test on the surface layer of Si is extended, and the water jet is continuously applied to the surface layer for 60 seconds. This result is illustrated in FIG. 12.

An area to which the water jet is applied is slightly polished and can be discriminated. However, it is found that the area is hardly abraded.

As a result, the high erosion resistance of the surface layer according to this embodiment can be confirmed.

A test for finding appropriate conditions for use in a steam turbine was performed based on the results described above. The shape of corrosion was examined by applying water jet to each film under the conditions shown in FIG. 13.

Figure 13:
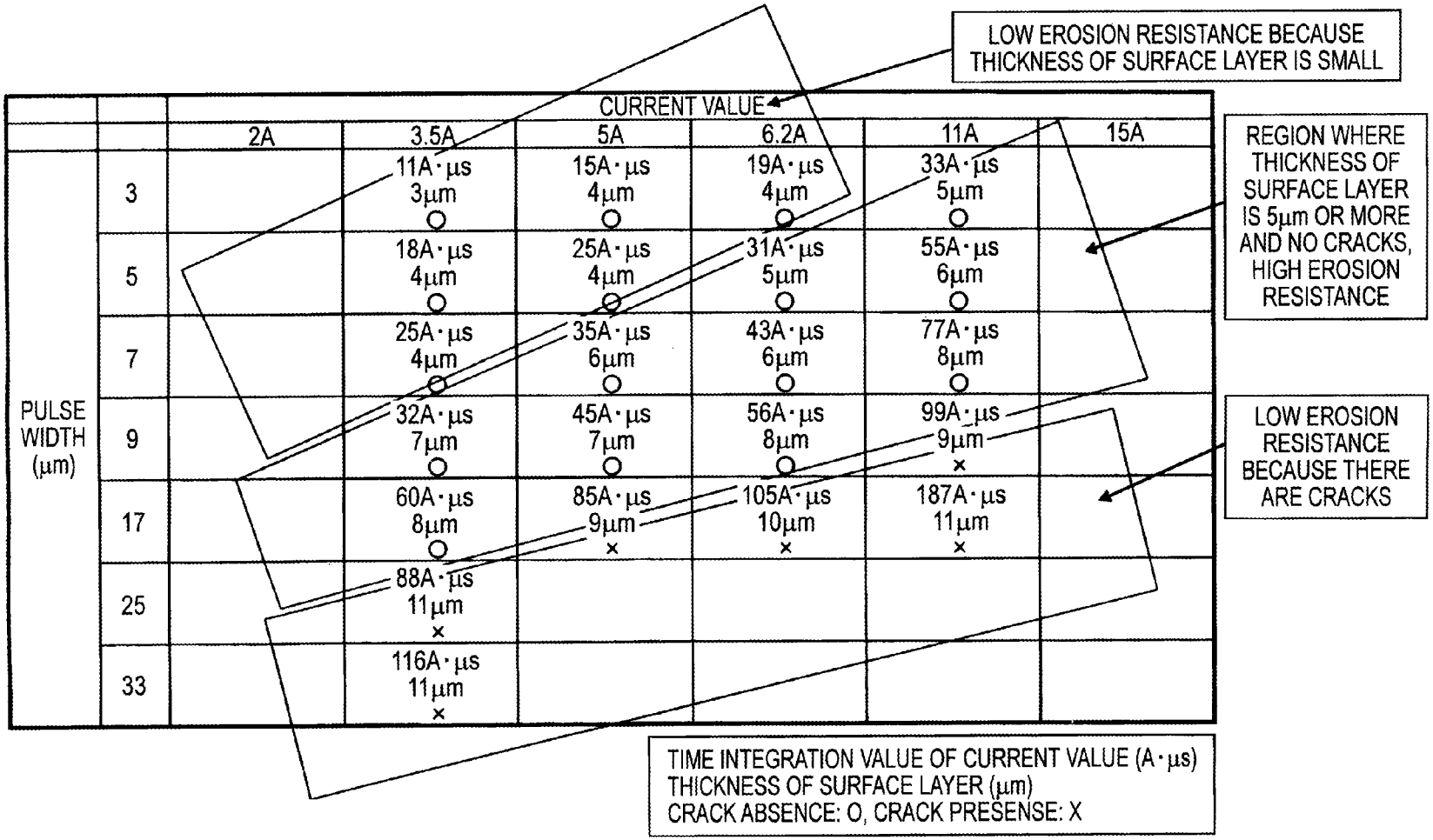
FIG. 13 is a condition list table of a Si surface layer.

FIG. 13 shows, for each treating condition, time integration value (A·μs) of the current value of a electric discharge pulse corresponding to the energy of a electric discharge pulse under the condition (in case of square wave, current value ie×pulse width te), the thickness of the Si surface layer under the condition and whether there is a crack in the Si surface layer or not.

A current pulse of a square wave was used as the treating conditions, by putting the current value ie and the pulse width te in the horizontal axis and the vertical axis, respectively. A base material used in this test is SUS630.

The test was performed by using a Si electrode having $\rho=0.01\ \Omega$cm. The test was performed by preparing an electrode having a size within a range where an electric discharge pulse is normally generated.

It can be seen from the drawings whether there is a crack, as one of the conditions for forming the Si surface layer. The fact whether there is a crack has a strong correlation with the energy of the electric discharge pulse, and can be seen that the condition for forming a Si surface layer without a crack is that the time integration value of the electric discharge current corresponding to the energy of the electric discharge pulse is in a range of 80 A·μs or less.

Obviously, the fact whether a crack is generated depending on the machining condition is slightly influenced by the base material.

For example, among the materials called stainless steel, a crack is relatively difficult to be generated for a solid solution material, such as SUS304, and a crack is slightly easier to be generated for a precipitation hardening material, such as SUS630. Since precipitation hardening stainless steel, such as SUS630, is generally used for the steam turbine, the preferable range without a crack is narrower than austenite-based stainless steel, such as SUS304.

In FIG. 13, there is the thickness of the Si surface layer as another one of the conditions for forming the Si surface layer.

As can be seen from FIG. 13, the thickness of the Si surface layer is also correlated with the time integration value of the electric discharge current corresponding to the energy of the electric discharge pulse, such that it can be seen that the thickness decreases with the decrease in the time integration value of the electric discharge current and the thickness increases with the increase in the time integration value of the electric discharge current.

The thickness described herein implies a range which is melted by the energy of electric discharge and where Si, which is the electrode component, is diffused.

Although the influence range of heat is determined based on the largeness of the time integration value of the electric discharge current corresponding to the magnitude of the energy of the electric discharge pulse, the amount of diffused Si is also influenced by the number of times of electric discharge generation. Naturally, when the number of times of the electric discharge is small, the amount of Si in the Si surface layer becomes small because Si cannot sufficiently diffuse. On the contrary, even if the electric discharge is generated more than sufficiently, the amount of Si in the Si surface layer is saturated at a predetermined value and does not increase any more.

When the amount of Si is small, the effect of the Si surface layer described later may not be sufficiently achieved. When a sufficient amount of Si is diffused in the Si surface layer, the amount of Si was 3 to 11 wt %. In a Si surface layer that was formed more stably, the amount of Si was 6 to 9 wt %. The amount of Si disclosed herein is a value measured by an energy distribution type X-ray fluorescence spectrometric method (EDX), and the measuring condition is acceleration voltage of 15.0 kV and radiated current of 1.0 nA. Further, the amount of Si is a value of a portion that shows nearly the maximum value within the surface layer.

The amount of Si in the Si surface layer is optimum at 6 to 9 wt %. Within this range, the treated surface is smooth and there is substantially no roughness on the surface that may be a starting point of erosion. Since Si is contained in the surface, the base material melted by electric discharge and the Si material of the electrode can be smoothly solidified. As the amount of Si decreases, the function of smoothing the molten material is reduced. When the amount of Si is less than 3 wt %, it can be seen that concave-convex portion, when a material melted by electric discharge and solidified is hardened, is more noticeable, a portion that is the starting point of damage when water drops or the like hit against it is generated, and erosion resistance cannot be achieved.

On the contrary, it can be seen that in order to increase the amount of Si, it is required to elongate the pulse width te. As the pulse width is elongated, the unevenness of the surface is correspondingly increased by the condition.

It can be seen that the portions that are the starting point of damage are increased due to large unevenness of the surface when the amount of Si is set at 11 wt % or more.

As described above, it can be seen that the amount of Si in the Si surface layer is 3 to 11 wt %, and more preferably 6 to 9 wt %. The range of the hardness of the Si surface layer where the above-described effect can be achieved was 600 HV to 1100 HV.

Figure 14:
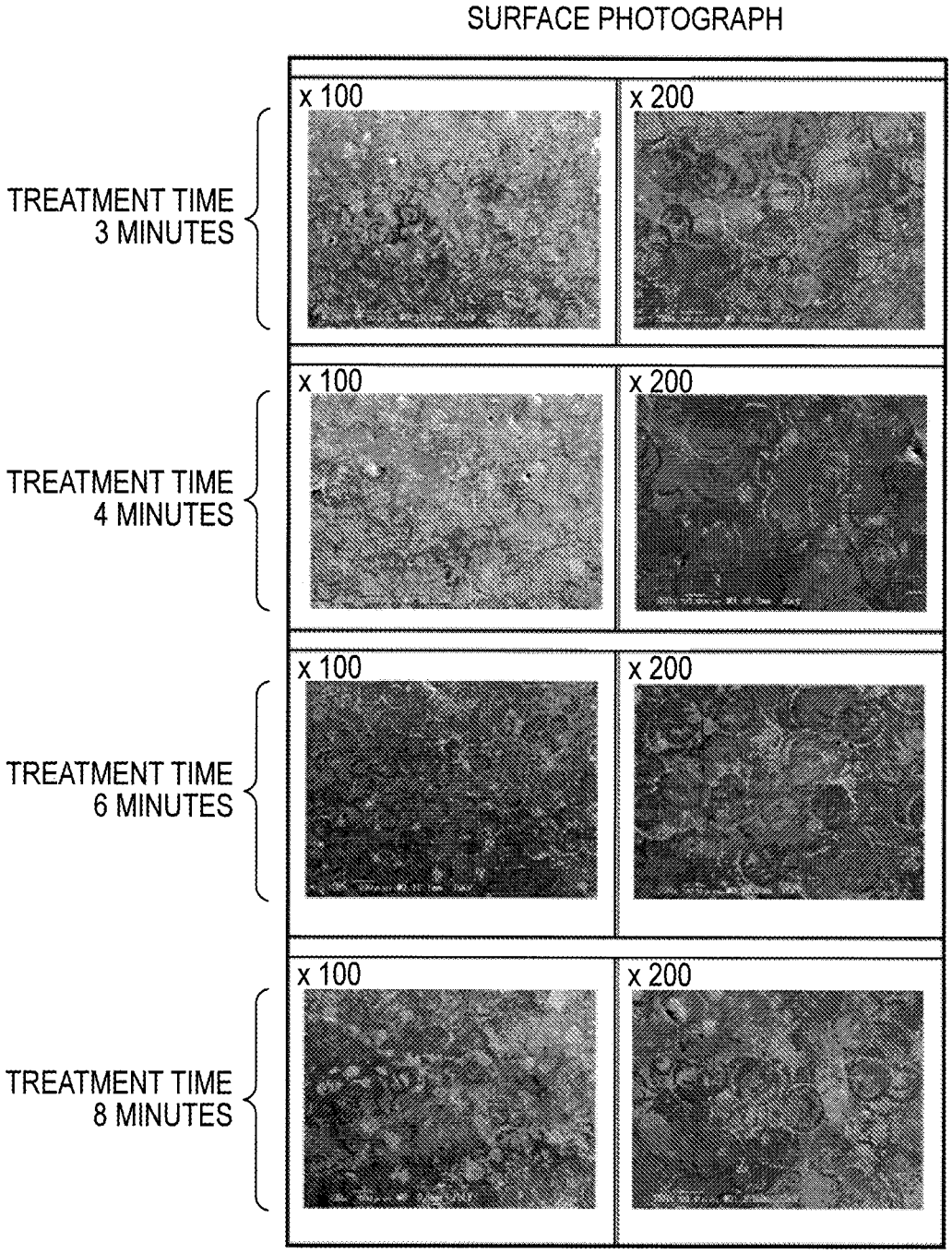
FIG. 14 is a photograph of the surface of a Si surface layer.
Figure 15:
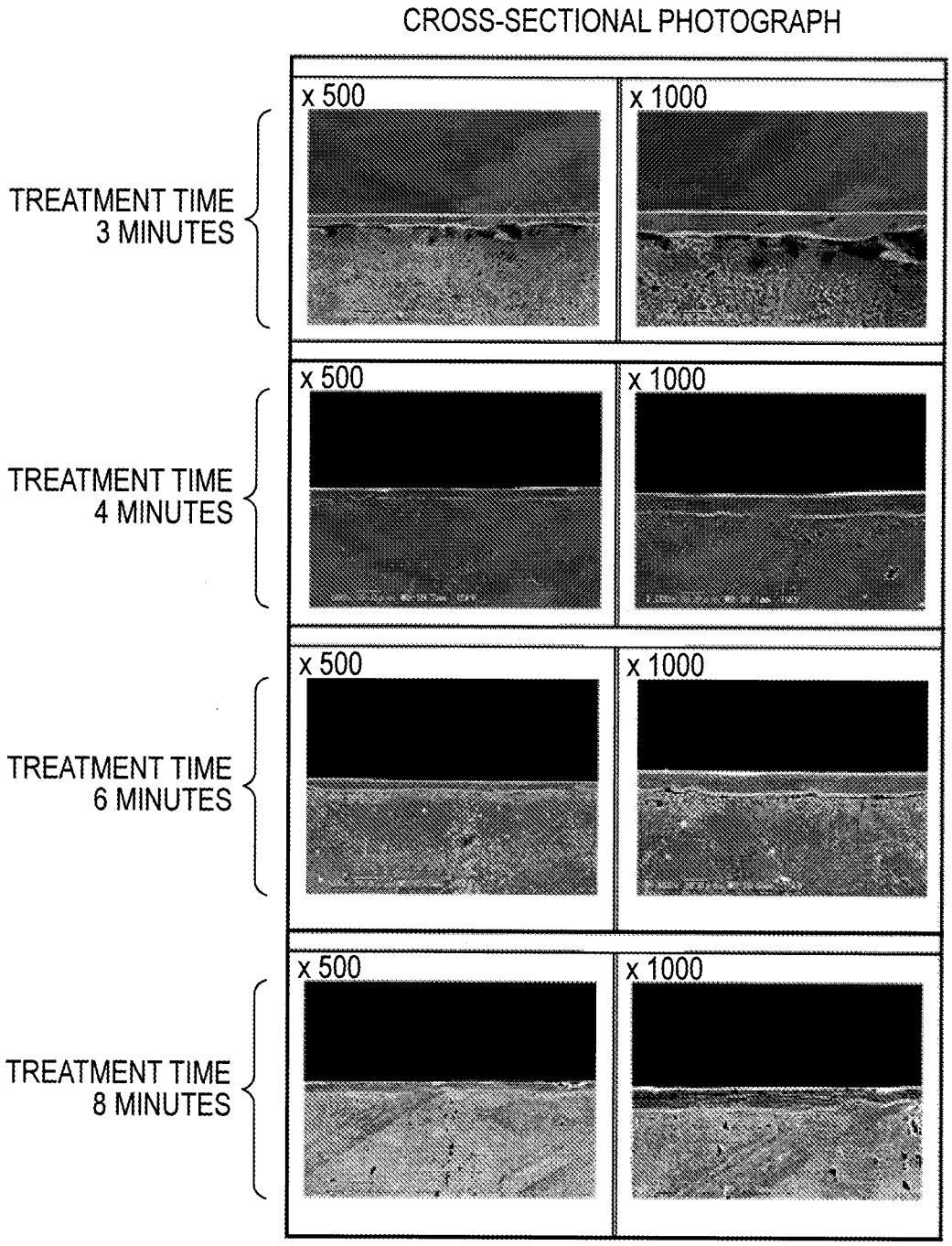
FIG. 15 is a photograph of a cross-section of a Si surface layer.

It has been described that the amount of Si in the Si surface layer influences the characteristics of the unevenness of the surface. The examples thereof are shown in FIGS. 14 and 15.

The surface of the Si surface layer (FIG. 14) and the cross-section of the Si surface layer (FIG. 15) were observed, by changing the processes under the constant treating conditions of the Si electrode for each time.

Since all the processes are performed under constant treating conditions, the treating conditions may be considered as being substantially the same as the ratio of the number of times of generated electric discharge. That is, the number of electric discharge times is small when the treatment time is short, and the number of electric discharge times is large when the treatment time is long (however, since the treatment time depends on conditions, such as the break time, in order to generate the same number of electric discharge pulses, the necessary treatment time changes when the break time changes).

The treatment times of the Si surface layer shown in the figures are 3 minutes, 4 minutes, 6 minutes, and 8 minutes. The following can be seen from the figure.

When the treatment time is short (3 minutes), there are many concavo-of the surface and small protrusions are observed on the surface (though not shown, when the treatment time is even shorter, there are even more protrusions, such that 3 minutes of the treatment time is the boundary where protrusions become hard to be noticed).

It can be seen that as the treatment time increases, the concavo-convexes and the protrusions decrease, and the surface becomes smooth.

Meanwhile, it can be seen from the cross-sectional photograph that the thickness of the Si surface layer does not substantially change on the cross-section based on the treatment times from 3 minutes to 8 minutes. When analyzing the Si amount for each of the films, it was about 3 wt % in the film of 3 minutes of treatment time, about 6 wt % in the film of 4 minutes of treatment time, about 8 wt % in the film of 6 minutes of treatment time, and about 6 wt % in the film of 8 minutes of treatment time. It could be seen that Si is not sufficiently diffused in the surface layer when the treatment time is short, but sufficient Si is diffused after a predetermined treatment time passes (4 minutes in the conditions) and the surface becomes smooth. It can be seen from the above that when the amount of Si is small, the smoothness is bad, such that 3 wt % or more is required, and more preferably, 6 wt % or more is required.

Although the description being late, the performance of the Si surface layer will be described hereinafter.

There are largely two modes of erosion, where one is a mode in which large scooping out is caused by impact of water and the other one is a mode in which the surface is scratched and scraped away by water that strongly hits against and flows on the surface.

Figure 16:
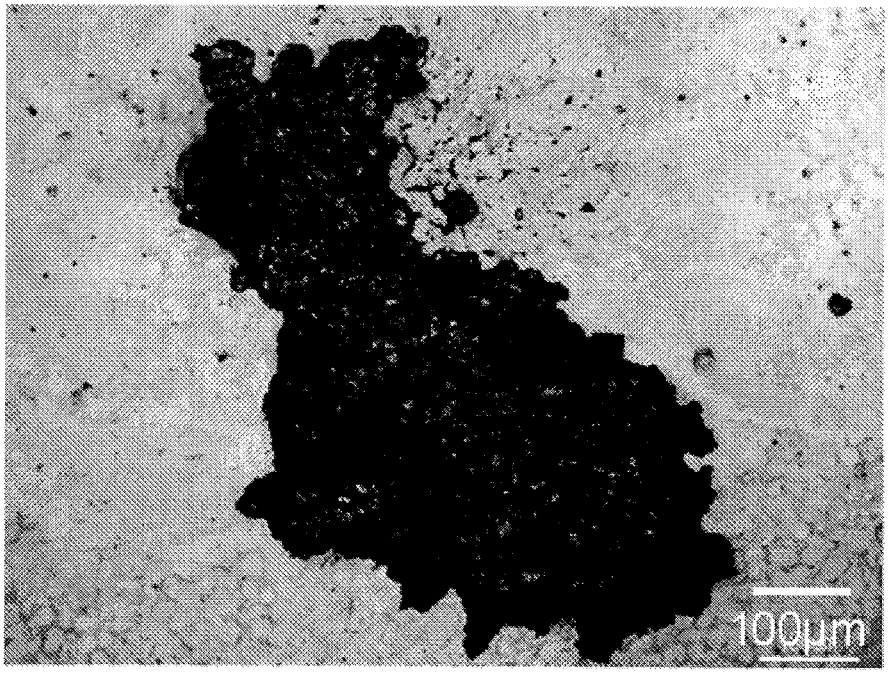
FIG. 16 is a photograph illustrating a Si surface layer being broken.

FIG. 16 is a result of break of the Si surface layer when water jet is applied at 200 MPa for 60 seconds to the Si surface layer having a thickness of 3 μm. It can be seen that a trace such as a fine scratch is not shown, but it is broken as if it has been largely scooped out. This is considered to be a damage not caused by hitting of water, but that the Si surface layer is broken by the impact of a large amount of water of the water jet. That is, when the Si surface layer is thin at 4 μm or less, it is effective in the mode in which water scratches and scrapes away the surface while strongly hitting against and flowing on the surface. However, it is less effective in the mode where the surface is largely scooped out by the impact of water.

Figure 17:
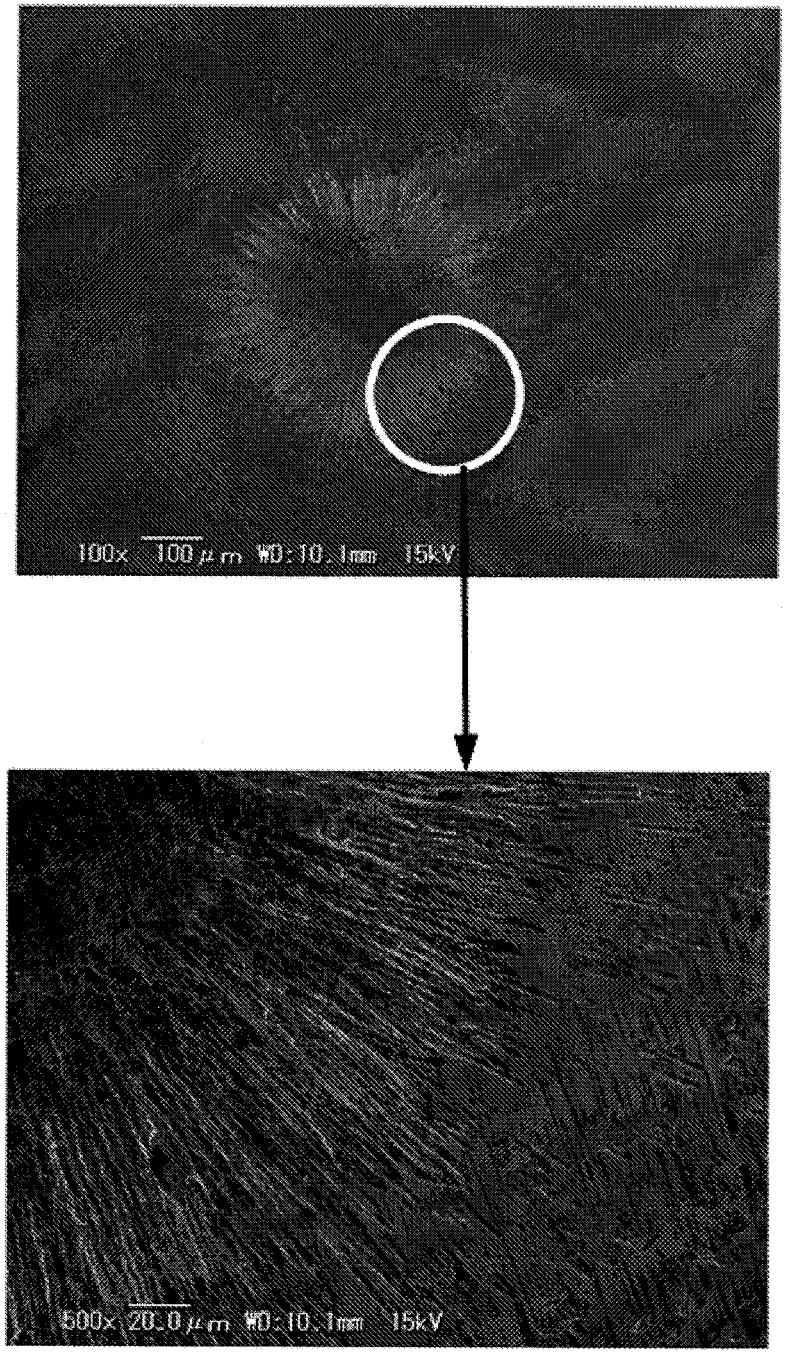
FIG. 17 is a photograph illustrating erosion of Stellite.

FIG. 17 shows the result of using a Stellite No. 6 single body that is a material having high erosion resistance and applying water jet at 90 MPa for 60 seconds. The figure represents the mode where the surface is scratched and scraped away by water that strongly hits against and flows on the surface.

Figure 18:
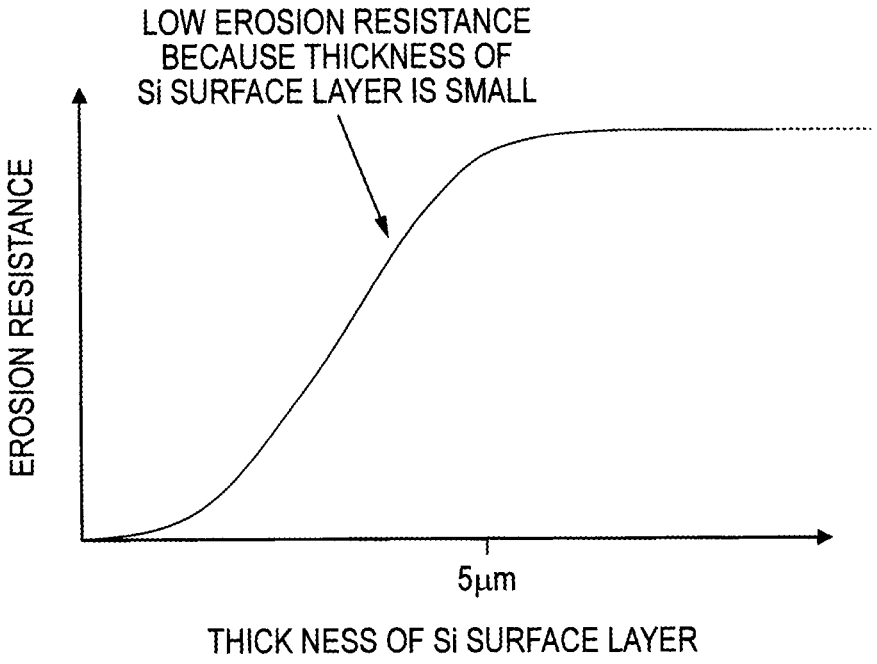
FIG. 18 is an erosion resistance characteristic view of a Si surface layer.

Next, the relationship between the thickness of the Si surface layer and the erosion resistance is shown in FIG. 18.

As shown in the figure, when the thickness of the Si surface layer is 4 μm or less and water jet is applied at nearly sound speed corresponding to the speed where water drops hit against the turbine blades of a steam turbine, it can be seen that a phenomenon occurs with high probability where the film cannot stand and the surface is broken when the Si surface layer is thin.

The reason that it is weak to impact when the Si surface layer is thin and it is strong to impact when it is thick can be estimated from the followings. That is, when the Si surface layer is thin, while impact is applied, distortion is gradually accumulated and the grain boundary of the parent material is consequently broken. When the Si surface layer is thick, it is hard for the distortion to reach the parent material, such that the base material is protected. In the meantime, since the Si surface layer is a texture close to an amorphous structure, no breaking occurs at a grain boundary since there is grain boundary.

In this viewpoint, the energy of the electric discharge pulse needs to be increased in order to make the Si surface layer thick, and the energy of electric discharge pulse is necessarily 30 A·μs or more in order to make the thickness 5 μm or more.

As described above, it is possible to increase erosion resistance by making the Si surface layer thick. However, there is also a problem due to the increase of the thickness, such that the erosion resistance may be deteriorated thereby. As described above, in order to make the Si surface layer thick, the energy of electric discharge pulse needs to be increased. However, cracks are generated on the surface due to the increase in energy of the electric discharge pulse and the influence of heat increases. Since the larger the energy of the electric discharge pulse, the more the crack are easily generated, as described above, a crack is generated in the surface when it is treated by a pulse of 80 A·μs or more.

Figure 19:
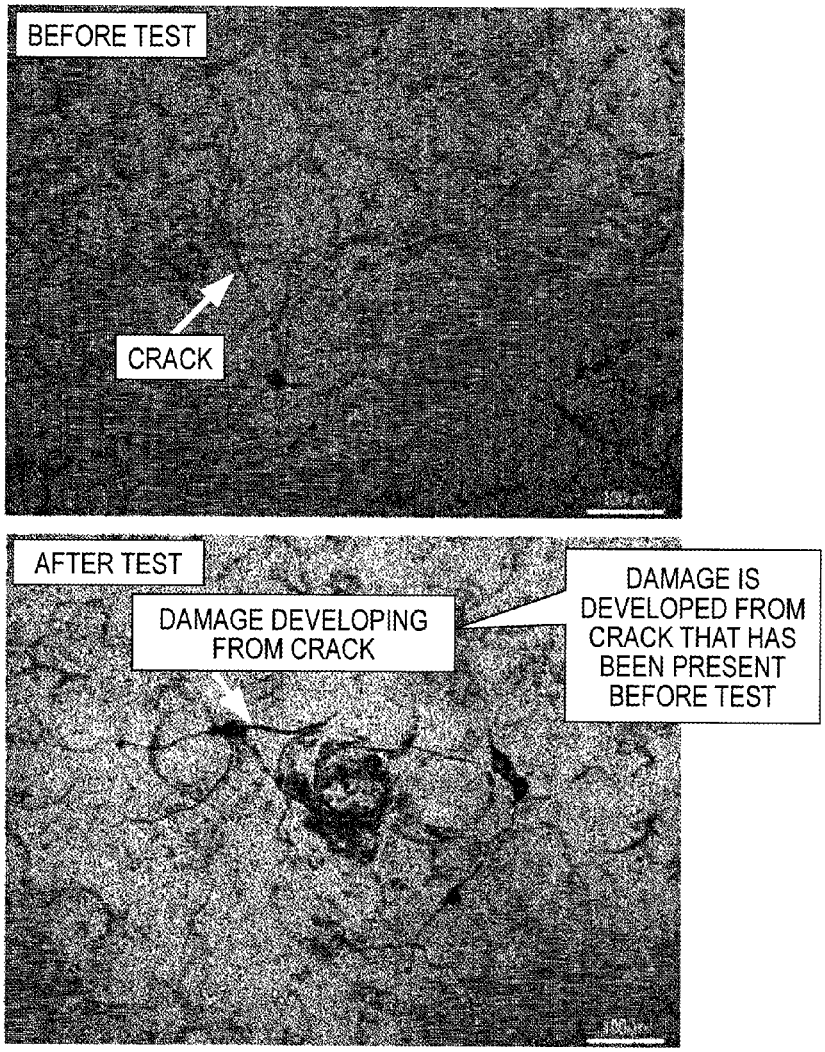
FIG. 19 is a photograph illustrating when cracks are developed on a Si surface layer.

It has been found out that the erosion resistance considerably decreases when cracks are generated on the surface. FIG. 19 shows the cracks being developed by applying water jet. When the water jet is continuously applied, the film is largely broken within a range. The film thickness becomes about 10 μm when it is treated under a pulse condition of energy of 80 A·μs, and it is found out that this is the actual upper limit of the Si surface layer for the erosion resistance.

Figure 20:
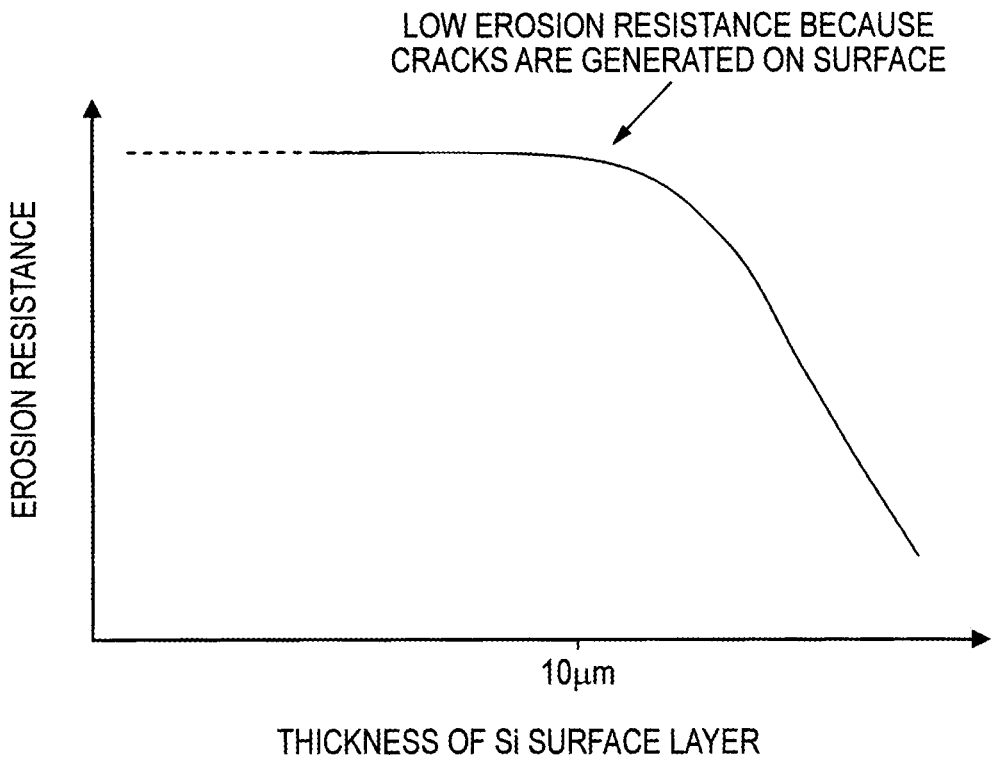
FIG. 20 is an erosion resistance characteristic view of a Si surface layer.
Figure 21:
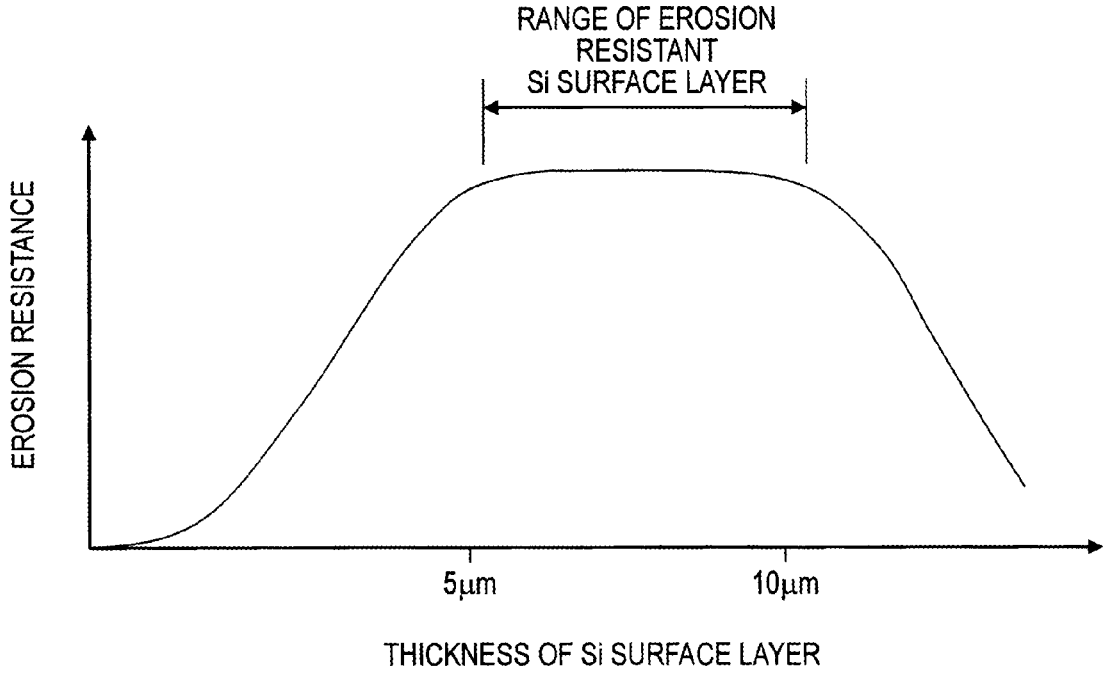
FIG. 21 is an erosion resistance characteristic view of a Si surface layer.

When the relationship between the film thickness of the Si surface layer and the erosion resistance is shown in the viewpoint of the crack, it is as shown in FIG. 20. It is found out that the relationship between the film thickness of the Si surface layer and the erosion resistance becomes as shown in FIG. 21 when FIGS. 18 and 20 are combined.

The conclusion is as follows. In order to form a Si surface layer having erosion resistance, the Si surface layer needs to be 5 μm or more, and the energy of electric discharge pulse is necessarily 30 A·μs or more.

Meanwhile, in order to prevent cracks on the surface, it is required to make the energy of electric discharge pulse 80 A·μs or lower, and as a result, the Si surface layer becomes 10 μm or less.

That is, the condition for forming a Si surface layer having erosion resistance is that the film thickness is 5 μm to 10 μm and the energy of electric discharge pulse therefor is 30 A·μs to 80 A·μs. The film hardness in this case is in the range of 600 HV to 1100 HV.

The reason that the erosion resistance of the Si surface layer of the present invention is superior is considered in the following way. The erosion resistance is generally known to correlate with the hardness. However, as can be seen from the above evaluation result, there are things that cannot be explained simply by the hardness. It could be seen that as factors other than the hardness, the characteristic of the surface has an influence and a surface closer to a mirror-like surface has higher erosion resistance than a rough surface. The characteristic of the surface may be the reason that the Si surface layer has excellent erosion resistance. The Si surface layer has a certain degree of hardness of 600 HV to 1100 HV and the characteristic of the surface is a smooth surface. It is considered that these factors influence the erosion resistance.

Figure 22:
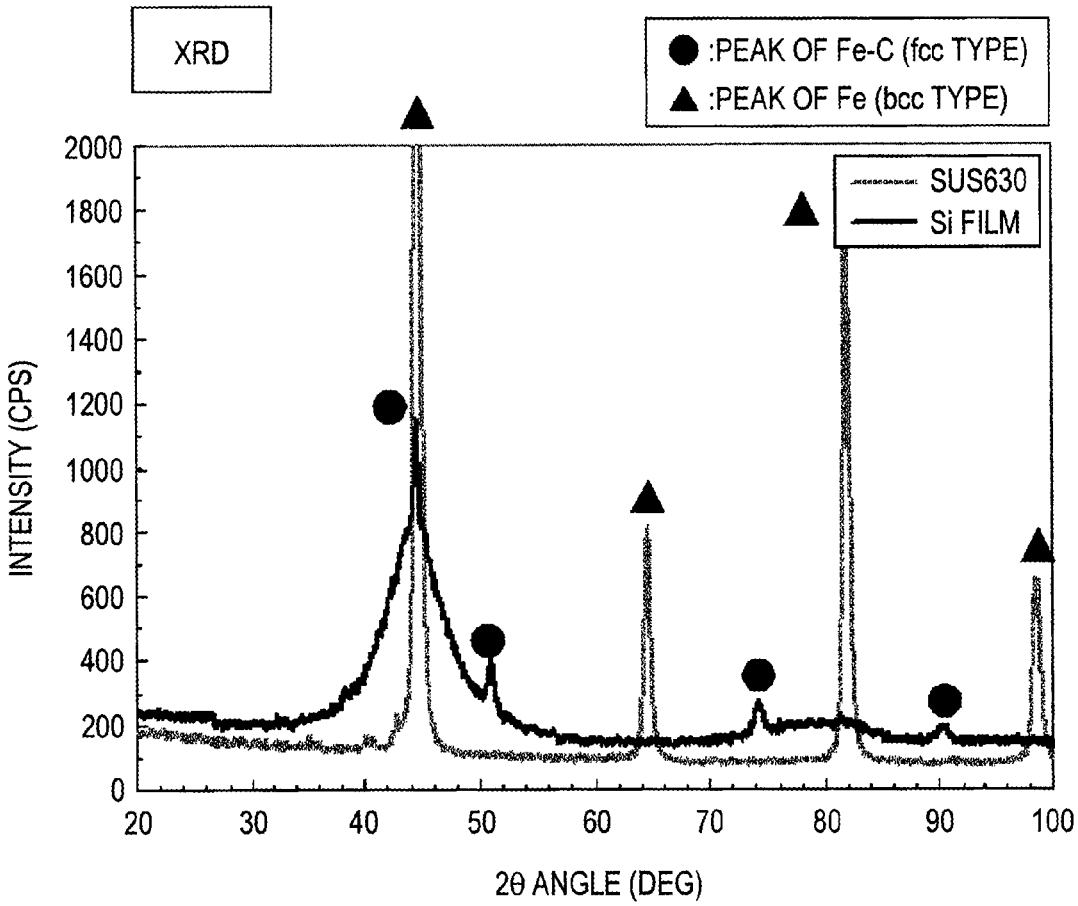
FIG. 22 is an X-ray diffracted image of a Si surface layer.

Further, toughness of a common high film (for example, the TiC film above, or a hard film formed by such as PVD and CVD) is low, such that the film is broken by a small deformation. However, the Si surface layer has high toughness, therefore, a crack is not easily generated even when deformation occurs, which is considered as one of reasons of the high erosion resistance. Further, it is considered that the crystalline structure of the Si surface layer has influence on the erosion resistance as well. An X-ray diffraction result of the Si surface layer formed under conditions within the range of the present invention is shown in FIG. 22. In FIG. 22, diffracted images are shown for SUS630 that is a base material, and for SUS630 on which the Si surface layer is formed. As can be seen from the diffracted image of the surface layer, although a peak of the base material is shown, a wide background where an amorphous (amorphous) structure is considered to be formed is observed. That is, the Si surface layer is an amorphous structure, such that it can be considered that breaking at the grain boundary, which can be easily generated in common materials, is difficult to be generated.

It is understood that the high erosion resistant surface layer is obtained according to this embodiment. The real application technology will be described.

In the following application technology, a technology in which the base technology described above is applied to a real intended purpose will be described. Therefore, in the following description, it is assumed that the technology described above is used, and the same description is not repeated.

Figure 23:
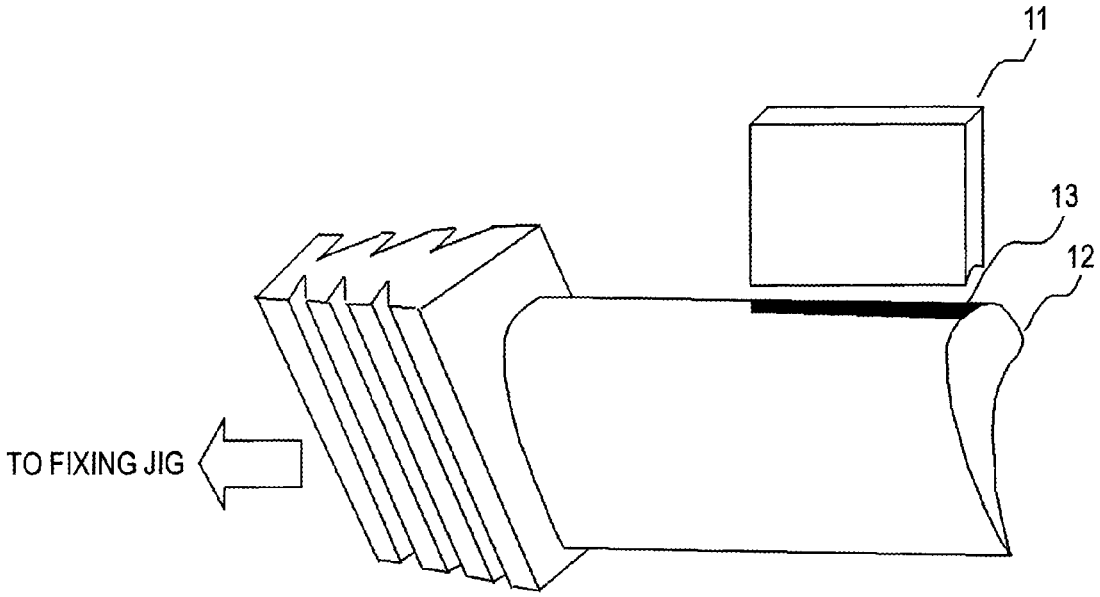
FIG. 23 is a diagram illustrating a process in which a Si surface layer is formed on a steam turbine rotor blade.

FIG. 23 illustrates an appearance in which the Si surface layer of the present invention is formed on a steam turbine rotor blade where the erosion is frequently problematic.

In the figure, 11 is a Si electrode, 12 is a steam turbine rotor blade that is a member to be treated, and 13 is a surface layer including Si which is formed on the surface of the steam turbine rotor blade 12. The steam turbine rotor blade 12 is positioned by a jig not shown, and fixed. In a real machining, if a tree part of a base is fixed, the steam turbine rotor blade can be stably fixed.

In the surface layer formation by electric discharge, there is a need to immerse an electric discharge part in oil. Therefore, it is convenient to install the jig not shown in a work tank for saving the oil in practical use.

In the case of the steam turbine, erosion occurs in a front edge of the rotor blade as described in the above-mentioned Patent Documents.

In the figure, the Si electrode conforming to a shape of a side requiring the erosion resistance is created, and is allowed to face the steam turbine rotor blade in the oil not shown.

Si does not damage another member (turbine rotor blade) even if electric discharge is continued for a long time, and therefore the shape may be followed by electric discharge. In the treatment of attaching another material through the conventional welding, thermal spraying, or brazing, heat input is large and the member is deformed. On the other hand, in the method of the electric discharge surface treatment, because the member is hardly deformed, if the electrode is formed in conformity with the shape of the member, it can be repetitively used without change.

Hence, although the conventional method required human skill, in this embodiment, because work is performed by a machine, a stable treatment can be performed without depending on a person.

Through the above method, the surface layer having the high erosion resistance can be automatically formed on the steam turbine rotor blade. However, it may be hard to form an electrode having a large area.

Figure 24:
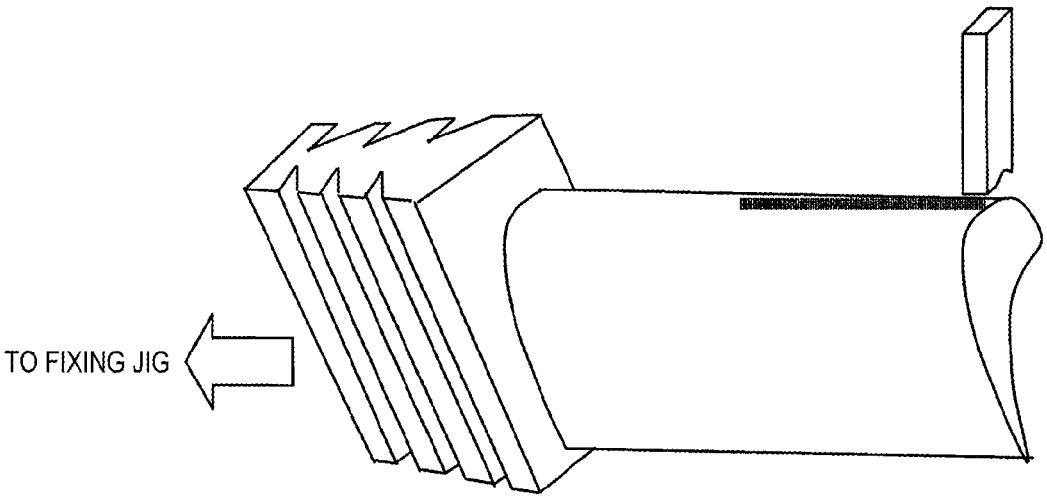
FIG. 24 is a diagram illustrating a process in which a Si surface layer is formed on a steam turbine rotor blade.

In this case, a thin electrode is produced as illustrated in FIG. 24, and the electrode is scanned according to a treatment progress whereby the entire necessary part can be treated.

Because a front edge of the steam turbine rotor blade is bent, although the electrode shape does not match the shape of the rotor blade cross-section only by scanning with the electrode having the same shape, the thickness of the electrode is thinned to promote the consumption of the electrode, thereby making it easy for the electrode to conform with the shape of the member.

Figure 25:
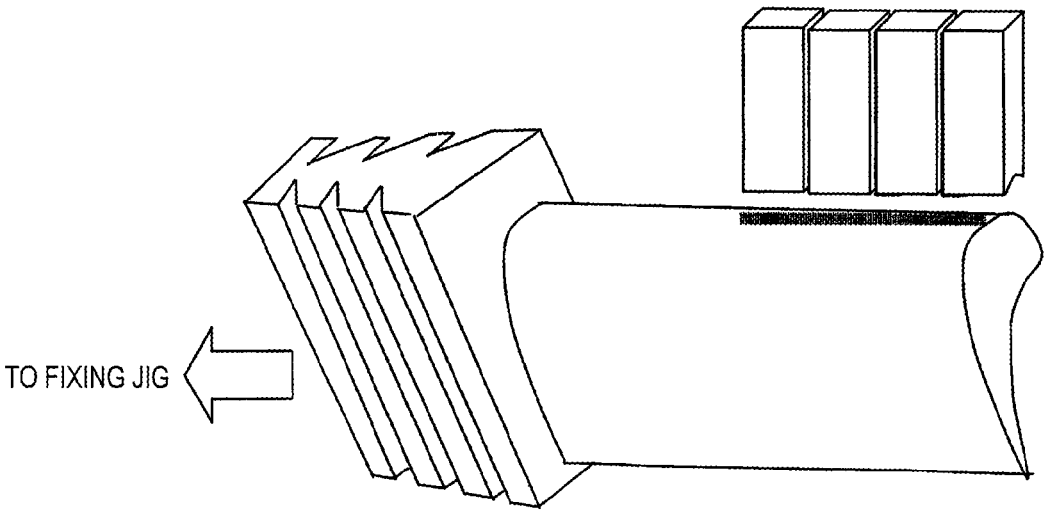
FIG. 25 is a diagram illustrating a process in which a Si surface layer is formed on a steam turbine rotor blade.

Through the above method, the surface layer having the high erosion resistance can be automatically formed on the steam turbine rotor blade. However, there arises such a problem that it takes long treating time if the treatment area is large. In this case, as illustrated in FIG. 25, the electrode is divided into pieces, and electricity is fed to the respective pieces, independently, so that the treating time can be reduced.

A gap between the electrodes is treated while slightly moving the electrodes for a distance larger than the gap, whereby the film can be formed without any gap.

A steam turbine rotor blade is commonly made by forming a schematic shape of the blade by forging, then forming a detailed shape by machining such as cutting, and then brazing or welding is performed for erosion resistance. Subsequently, finishing is finally performed following a process to correct the distortion and a heat treatment. By using the technology of the present invention, erosion resistance can be given by forming a schematic shape by forging, forming a detailed shape by cutting, finishing, and finally performing a treatment of forming a Si surface layer. The processing can be reduced as well to save a substantial cost.

In this embodiment, a case in which the erosion resistant component is applied to the rotor blade of the steam turbine has been described. However, it is needless to say that the same can be applied to other erosion resistant components intended purpose requiring the erosion resistance.

For example, an inner part of a piping which strongly collides with fluid, and a part of a shape where cavitation is liable to occur can be treated in the same manner. Such intended purpose includes a fuel inject component.

INDUSTRIAL APPLICABILITY

It is useful to apply the surface layer forming method according to the present invention to erosion resistant components.

DESCRIPTION OF REFERENCE NUMBERS

1, Si electrode; 2, member; 3, machining fluid; 4, DC power supply; 5, switching element; 6, current-limiting resistor; 7, control circuit; 8, electric discharge detector circuit; 11, Si electrode; 12, steam turbine rotor blade; and 13, surface layer including Si

The invention claimed is:

1. A method for forming a surface layer, the method comprising:

arranging a member in a machining fluid;

spacing a silicon electrode from the member at a predetermined distance; and forming an iron-based metal layer including silicon on a surface of the member by supplying silicon component from the silicon electrode to the member by applying a predetermined voltage and repetitively generating electric discharge, wherein a time integration of a current value of the electric discharge pulse is ranged between 30 A·μs and 80 A·μs, and wherein the iron-based metal layer includes 3 to 11 wt % of silicon and has a thickness of 5 to 10 μm.

2. The method for forming a surface layer according to claim 1, wherein the silicon electrode has a specific resistance of 0.01 Ωcm or lower.

* * * * *